US009795819B2

(12) United States Patent
Wehrell

(10) Patent No.: US 9,795,819 B2
(45) Date of Patent: Oct. 24, 2017

(54) SELF-LOCOMOTION TRAINING SYSTEMS AND METHODS

(71) Applicant: Michael A Wehrell, Tampa, FL (US)

(72) Inventor: Michael A Wehrell, Tampa, FL (US)

(73) Assignee: Michael A. Wehrell, Tampa, FL (US)

( * ) Notice: Subject to any disclaimer, the term of this patent is extended or adjusted under 35 U.S.C. 154(b) by 0 days.

(21) Appl. No.: 14/531,766

(22) Filed: Nov. 3, 2014

(65) Prior Publication Data

US 2015/0126344 A1 May 7, 2015

Related U.S. Application Data

(60) Provisional application No. 61/898,872, filed on Nov. 1, 2013, provisional application No. 61/985,811, filed on Apr. 29, 2014.

(51) Int. Cl.
*A63B 21/00* (2006.01)
*A63B 21/04* (2006.01)
(Continued)

(52) U.S. Cl.
CPC ..... *A63B 21/0442* (2013.01); *A63B 21/0004* (2013.01); *A63B 21/005* (2013.01);
(Continued)

(58) Field of Classification Search
CPC ..... A63B 21/0552; A63B 21/0442; A63B 21/4009; A63B 21/0557; A63B 21/4025; A63B 21/4007; A63B 2208/02; A63B 21/4011; A63B 21/4017; A63B 21/00069; A63B 21/0004; A63B 21/0555; A63B 21/4035; A63B 21/4013; A63B 21/4043;
(Continued)

(56) References Cited

U.S. PATENT DOCUMENTS 760,374 A 5/1904 Belvoir
2,893,736 A 7/1959 Tesi
(Continued)

OTHER PUBLICATIONS

International Searching Authority, International Search Report corresponding International Application No. PCT/US2014/063721 mailed Mar. 26, 2015, 1pg.
International Searching Authority, International Search Report PCT/US08/07179 mailed Oct. 1, 2008, 1pg.

*Primary Examiner* — Andrew S Lo
(74) *Attorney, Agent, or Firm* — Duane Morris LLP

(57) ABSTRACT

Embodiments allow the application of a settable and/or a programmable resistance to a trainee's leg Drive Phase and/or Recovery Phase while walking or running over extended or infinite distances. Multiple mechanical or electrical feedback loops or combinations of both to monitor the applied resistance to the Trainee by the tether or tethers and then control the amount of breaking (drag) or propulsion created by the Mobile training module during the acceleration and constant speed training phases to accurately generate, control and transfer resistance through the elastic tethers to the Trainee. Embodiments apply multiple, non-varying loads or programmable loads to multiple body parts of a trainee where applied resistance can be manipulated to both increase or decrease over distance as desired by trainee while the trainee is walking, running or sprinting over any distance.

30 Claims, 23 Drawing Sheets

(51) Int. Cl.

| | |
|---|---|
| ***A63B 21/005*** | (2006.01) |
| ***A63B 21/055*** | (2006.01) |
| ***A63B 24/00*** | (2006.01) |
| ***A63B 23/04*** | (2006.01) |
| *A63B 21/008* | (2006.01) |
| *A63B 21/015* | (2006.01) |
| *A63B 21/06* | (2006.01) |

(52) U.S. Cl.

CPC .... *A63B 21/0058* (2013.01); *A63B 21/00065* (2013.01); *A63B 21/00181* (2013.01); *A63B 21/0552* (2013.01); *A63B 21/4045* (2015.10); *A63B 23/047* (2013.01); *A63B 24/0087* (2013.01); *A63B 21/0088* (2013.01); *A63B 21/015* (2013.01); *A63B 21/0618* (2013.01); *A63B 21/4009* (2015.10); *A63B 21/4011* (2015.10); *A63B 21/4013* (2015.10); *A63B 21/4021* (2015.10); *A63B 2024/0093* (2013.01); *A63B 2220/20* (2013.01); *A63B 2220/30* (2013.01); *A63B 2220/40* (2013.01)

(58) Field of Classification Search

CPC ..... A63B 21/00185; A63B 21/4021; A63B 21/16; A63B 21/4015; A63B 69/0059; A63B 21/154; A63B 23/03541; A63B 23/0355; A63B 21/00061; A63B 21/4005; A63B 21/055; A63B 2210/50; A63B 23/047; A63B 21/4001; A63B 23/1209; A63B 21/00065; A63B 21/02; A63B 21/0428

USPC ..... 482/121–125, 127–135

See application file for complete search history.

(56) References Cited

U.S. PATENT DOCUMENTS

| | | | | | |
|---|---|---|---|---|---|
| 3,752,474 | A | | 8/1973 | Macabet et al. | |
| 3,972,238 | A | * | 8/1976 | Thatcher | A61B 5/224 434/251 |
| 4,251,071 | A | | 2/1981 | Norton | |
| 4,469,324 | A | * | 9/1984 | Dolan | A63B 69/0028 104/173.2 |
| 4,551,108 | A | | 11/1985 | Bass | |
| 4,593,909 | A | | 6/1986 | Anselmo et al. | |
| 4,600,016 | A | * | 7/1986 | Boyd | A61B 5/1038 600/592 |
| 4,685,670 | A | | 8/1987 | Zinkin | |
| 4,813,664 | A | * | 3/1989 | Vroulis | A61H 3/04 280/87.021 |
| 4,863,163 | A | | 9/1989 | Wehrell | |
| 4,913,423 | A | | 4/1990 | Farran et al. | |
| 4,968,028 | A | | 11/1990 | Wehrell | |
| 5,048,836 | A | | 9/1991 | Bellagamba | |
| 5,050,871 | A | | 9/1991 | Douglas et al. | |
| 5,070,816 | A | | 12/1991 | Wehrell | |
| 5,176,597 | A | * | 1/1993 | Bryne | A61H 3/008 482/54 |
| 5,197,931 | A | | 3/1993 | Wroclawsky | |
| 5,234,392 | A | * | 8/1993 | Clark | A63B 69/0035 482/112 |
| 5,242,339 | A | | 9/1993 | Thornton | |
| 5,451,194 | A | | 9/1995 | Harrigan | |
| 5,468,205 | A | | 11/1995 | McFall et al. | |
| 5,472,394 | A | * | 12/1995 | Michaelson | A63B 21/0088 244/142 |
| 5,512,029 | A | | 4/1996 | Barnard et al. | |
| 5,540,642 | A | | 7/1996 | Sprague | |
| 5,545,113 | A | * | 8/1996 | Bobich | A63B 21/0004 482/124 |
| 5,586,962 | A | | 12/1996 | Hallmark | |
| 5,597,376 | A | | 1/1997 | Bode et al. | |
| 5,613,926 | A | | 3/1997 | Michaelson | |
| 5,618,249 | A | * | 4/1997 | Marshall | A63B 21/153 482/115 |
| 5,653,665 | A | | 8/1997 | Neeley | |
| 5,683,336 | A | * | 11/1997 | Pape | A63B 21/0004 482/111 |
| 5,803,822 | A | | 9/1998 | Pursell | |
| 5,916,070 | A | * | 6/1999 | Donohue | A63B 21/151 482/114 |
| 5,924,933 | A | | 7/1999 | Pacheco | |
| 5,941,807 | A | | 8/1999 | Cassidy et al. | |
| 6,053,850 | A | * | 4/2000 | Martinez | A63B 21/015 482/118 |
| 6,099,446 | A | * | 8/2000 | Johnson | A63B 21/0004 482/124 |
| 6,106,444 | A | | 8/2000 | Maingart | |
| 6,120,418 | A | | 9/2000 | Plough | |
| 6,123,649 | A | | 9/2000 | Lee et al. | |
| 6,158,389 | A | | 12/2000 | Wehrell | |
| 6,220,994 | B1 | | 4/2001 | Rich | |
| 6,267,711 | B1 | | 7/2001 | Hinds | |
| 6,280,365 | B1 | * | 8/2001 | Weber | A63B 21/018 482/124 |
| 6,454,679 | B1 | * | 9/2002 | Radow | A63B 22/0235 482/4 |
| 6,554,747 | B1 | | 4/2003 | Rempe | |
| 6,612,845 | B1 | | 9/2003 | Macri et al. | |
| 6,634,998 | B2 | | 10/2003 | Siaperas | |
| 6,652,427 | B2 | | 11/2003 | Wroclawsky | |
| 6,676,569 | B1 | * | 1/2004 | Radow | A63B 22/0235 482/4 |
| 6,726,606 | B2 | | 4/2004 | Jacobsen | |
| 6,966,870 | B2 | | 11/2005 | Lan | |
| 7,089,720 | B2 | * | 8/2006 | Kurt | A01K 15/027 119/422 |
| 7,297,090 | B2 | * | 11/2007 | Torres | A63B 21/015 482/124 |
| 7,322,905 | B2 | * | 1/2008 | Morris | A63B 69/345 482/118 |
| 7,384,382 | B2 | * | 6/2008 | Farrah | A63B 21/153 273/453 |
| 7,563,212 | B2 | * | 7/2009 | Smith | A63B 21/025 482/124 |
| 7,575,537 | B2 | * | 8/2009 | Ellis | A63B 21/00076 482/5 |
| 7,998,030 | B2 | | 8/2011 | Wroclawsky | |
| 8,100,816 | B2 | * | 1/2012 | Daniel | A63B 21/0618 280/1.5 |
| 8,398,529 | B2 | * | 3/2013 | Ellis | A63B 21/155 482/124 |
| 2003/0158024 | A1 | | 8/2003 | Saure | |
| 2005/0032613 | A1 | | 2/2005 | Wehrell | |
| 2005/0043156 | A1 | | 2/2005 | Wehrell | |
| 2005/0272572 | A1 | * | 12/2005 | Lewis | A63B 21/0618 482/93 |
| 2006/0229175 | A1 | * | 10/2006 | Frappier | A63B 21/00065 482/124 |
| 2007/0135279 | A1 | * | 6/2007 | Purdy | A63B 21/0004 482/124 |
| 2010/0041527 | A1 | * | 2/2010 | Miller | A63B 21/0552 482/124 |
| 2010/0048363 | A1 | * | 2/2010 | Gilberti | A63B 21/0603 482/105 |
| 2010/0105531 | A1 | * | 4/2010 | Crawford | A63B 21/00185 482/124 |
| 2010/0323848 | A1 | * | 12/2010 | Wroclawsky | A63B 69/0028 482/51 |
| 2011/0111890 | A1 | * | 5/2011 | Webb | A63B 69/0002 473/458 |
| 2014/0206508 | A1 | * | 7/2014 | Hall | A63B 21/065 482/105 |

* cited by examiner

Rear View

SELF-LOCOMOTION TRAINING SYSTEMS AND METHODS

CROSS-REFERENCE TO RELATED APPLICATIONS

This application claims priority under 35 U.S.C. §119(e) from U.S. Provisional Patent Application Ser. No. 61/898,872 filed Nov. 1, 2013, the entirety of which is hereby incorporated by reference herein, and U.S. Provisional Patent Application Ser. No. 61/985,811 filed Apr. 29, 2014, the entirety of which is hereby incorporated by reference herein.

BACKGROUND

The present disclosure relates to self-locomotion training systems and methods having the capability of applying resistance to a trainee during the act of self-locomotion. More specifically, according to the present disclosure, the self-locomotion may be in the form of walking, running, hopping, skipping, shuffling, crawling, or any other form of moving one's body from one point to another point. The system may provide resistance to the movement of multiple body parts of the trainee during the act of self-locomotion in order to train multiple muscle groups engaged during such activity.

The desire to push athletic performance to new heights is a common goal for most every trainee—for example, acceleration and top end speed as it relates to running. It has been discovered that a trainee's ability to generate force (or power) and apply that force to the supporting surface can be improved more effectively for the purposes of increasing running speed if the trainee can train with resistive loads at relatively high velocities. Currently there is no training system or method that can apply fixed or programmable loads simultaneously to the drive phase (quad, glut and calf muscles) and swing phase (hip flexor muscles) of the act of self-locomotion (e.g., running) over a large range of velocities for extended distances. Furthermore there is no system that can apply simultaneous loads to the muscles involved with the drive phase and swing phase plus arm drive of self-locomotion while a trainee moves over a surface for extended distances. The present disclosure provides systems and methods for advanced and efficient training to improve the trainee's ability move from one point to another during the act of self-locomotion, including for example, the ability to run faster over any prescribed distance.

The present disclosure provides systems and methods for applying one or more resistance loads to a trainee while self-locomoting without distance limitations. The present disclosure provides systems and methods for controlling the applied resistance to the trainee so that the resistance is stable and does not increase as a function of the distance travelled by the trainee. Additional embodiments of the present disclosure include mechanical or electromechanical means described herein to enable the trainee to selectively maintain or alter applied resistance levels at any point along the trainee's training path. The disclosure also provides the ability to apply selectable resistive loads to the trainee during the running motion for extended to infinite running distances. The disclosure further enables resistive loads to be applied uniquely to multiple portions of the trainee's body to facilitate strength development and thereby improve running speed. The disclosure also provides the ability to apply resistance to the drive phase (ground contact), swing phase (foot is airborne) and arm (push/pull phase) for extended to infinite running distances. The disclosure provides the ability to accurately control the applied resistance independent of the trainee's acceleration or velocity. The disclosure also includes means to apply resistive loads independent of the mass of the major system component. Minimizing the mass of the invention is desirable so a trainee may accelerate against the applied resistance while not having to overcome excessive inertia that would be present if the system components relied on mass to generate resistive loads. In some embodiments, the disclosure utilizes an electronic drive system so that the mass of the system would not be relevant to the trainee since the electronic drive system could be programed to compensate for the mass of the system when the trainee accelerates so that only the desired training resistance is applied to the trainee. Other embodiments may use a weighted mobile training module that slides on the supporting surface or may include wheels supporting the mobile training module to facilitate movement across the supporting surface. The mobile training module may be tethered to the trainee who pulls the mobile training module over the supporting surface such as the ground. Resistance modules containing elastic bands or other resistance means can be attached to the mobile training module while the elastic tethers exiting the resistance modules can be attached to the hands, ankles, waist and thighs of the trainee. Since the mobile training module containing the elastic resistance modules will shadow the trainee, the absolute distance between the trainee and mobile training module will not increase and the elastic tethers will be stretched and contracted within a predefined length (such as stride length) and thus apply a load that is stable and independent of distance travelled by the trainee.

The present disclosure eliminates the deficiencies of other systems that use elastic cords for providing resistance to a trainee. Such systems include significant deficiencies in loading a trainee that is walking or running in the opposite direction of the applied resistance. First, referencing FIG. 3, consider the training configuration with fixed length elastic bands 40-43 attached to a trainee, each with one end anchored to structure S. The band configuration and attachment points on the trainee in FIG. 3 will load the drive and swing phases of the walking and running motion of the trainee. However, due to the fixed length of the elastic bands the trainee will only be able to take a few steps before the bands reach their stretching limit and applied resistance becomes so great that the rainee can no longer walk or run with proper form. FIG. 1 shows a typical resistance curve for a prior art system shown in FIG. 3 or FIG. 4. Note graph (E) in FIG. 1. As the trainee runs and the elastic bands are stretched as a function of distance, the force required to stretch the elastic bands will increase exponentially as a function of distance. Relating the resistance profile of FIG. 1 to FIG. 3, as the trainee moves away from structure S, the elastic bands 40-43 will stretch and the applied resistance will increase with each stride. After a few strides the resistance will increase exponentially and eventually the elastic bands will stop stretching applying so much resistance that the trainee can no longer move away from structure S. Obviously such a training configuration to load muscles while walking or running particularly at high speeds is not practical or effective because the trainee's acceleration and running process will be prematurely stopped by the resistance applied by the fully or near fully stretched elastic bands long before the trainee reaches top speed, which is typically at 30 to 40 yards for humans. Simply increasing the length of elastic bands 40-43 to train for a greater distance does not provide a practical solution for many reasons. First, the trainee would have to position himself at a distance from structure S that would be slightly farther than the length of the longer elastic bands so that the bands would be taught and begin applying resistance. For example, if the Trainee decided to use 100 foot long elastic bands they would have to position themselves more than 100 feet away from structure S before the slack in the 100 foot bands would be taken up allowing the bands to become taught and apply resistance. Now 100 feet of space is required before the trainee can take a single step with applied training resistance. Secondly, the increased mass of the 100 foot bands lying between the trainee and structure S would have significant weight and would both severely restrict the natural running movement of a trainee's feet and overall balance and stability when running particularly at high speeds.

Referencing FIG. 4 and FIG. 5, advanced mechanisms using elastic bands to load the drive phases and swing phases have been developed which contain the mass of elongated bands on pulley systems within a module M. Such mechanisms can route multiple long elastic bands (30 feet or longer) on pulleys internal to module M and preload the elastic bands so the elastic bands are taught as soon as they emerge from module M. The elastic bands may apply resistance to a trainee within a foot of the module M and continue to apply a relatively constant resistance out to distances of approximately 120 feet. However, such devices also have distance limitations once the trainee reaches a certain distance from the module M. As the trainee accelerates away from module M increasing distance D, the force applied to the trainee will eventually increase exponentially causing the trainee to become destabilized and forced to stop abruptly.

The present disclosure includes multiple embodiments. One of the embodiments described herein comprises a mobile training module that is towed by the trainee. The mobile training module may include up to six retractable elastic tethers for connecting to the trainee for applying load to the trainee during the act of self-locomotion such as running. The mass/weight of the towed mobile training module is designed such that it may be light weight (less than 10 pounds) but includes the ability to generate resistance loading to the trainee of a magnitude that is many multiples of the weight of the module. A major advantage to high velocity training using elastic bands is the relatively light weight of the elastic bands. Since the elastic bands have relatively small mass, a trainee can accelerate very quickly working against elastic resistive loads having resistance to mass ratios that may exceed 200:1 as compared to resistive loads generated by dead weight such as steel weights whose resistance to mass ratio is 1:1.

One embodiment of the present disclosure may include a mobile training module and relatively short elastic bands ranging from 2 to 10 feet per band. The mobile training module may be coupled to the ground by one or two portable coupling belts or fixed tracks/guides that are laid out parallel to one another to define a training path. The coupling belts may be anchored to the ground. One to six elastic tethers emanating from the mobile training module are connected to the Trainee by any suitable means such as harnesses, wrist bands, ankle bands or the like. The force required to pull the mobile training module which is coupled to and guided by the coupling belts or coupling tracks may be controlled by mechanical and/or electronic means within the mobile training module. Once the trainee sets the resistance level or force to pull the mobile training module manually or by electronic programming and connects the elastic tethers to various points on their body, the trainee can accelerate while connected to the mobile training module which, via mechanical coupling to the coupling tracks or belts, generates the desired resistance which is transferred to the trainee through the tethers.

Some advantages of the present disclosure over the prior art include capability to apply a resistance profile as depicted in FIG. 2 whereby as graph (A) indicates, the magnitude of applied resistance can be kept constant independent of velocity or distance traveled by the trainee. Additionally as graph (B) indicates, the mobile training module may also provide a variable resistance independent of the velocity or distance traveled by the trainee.

To help understand why the proposed invention presents a novel exercise methodology for improved speed development and general human loco motion it will first be helpful to understand and become familiar with the four most common training methods utilized now among athletes to increase speed. These four methods involve:

a) pulling or pushing weighted mobile training modules;
b) tying the distal ends of a long elastic band to the waist of two trainees, having the Trainees separate until the elastic band provides the desired training load and then have one Trainee run away from the other and the second trainee tries to maintain a fixed separation to keep the desired load applied to the lead trainee;
c) running with a parachute to utilize wind resistance; and
d) the Wehrell "Lateral Training System and Method" as described in U.S. application Ser. No. 12/155,747.

Each of the identified prior art speed training methods (a-d) have major drawbacks that reduce the efficiency of strength development for the purposes of increasing athletic speed.

The drawbacks of the prior art include;

1) The current arts a-c mentioned only train (overload) muscles associated with the drive phase where the Trainee's foot is in contact with the ground and pushing—mainly the quad, gluts and calf. The muscles that are used to propel the leg through the air to the next step when it breaks contact with the ground are not overloaded with any training resistance with methods a-c. These untrained muscles include the hip flexors, adductors and abductors all of which happen to be critical for speed performance and thus the strength of these three muscle groups is highly relevant for improving speed.
2) With method (a) high training velocities are rarely achieved because of the significant mass of the mobile training modules which restrict sports specific acceleration and maximum training speeds to about 5 miles per hour on average for weighted mobile training modules. Thus, weighted mobile training module training velocities are significantly less than un-resisted maximum running speeds of 24 to 27 miles per hour for professional sprinters. It has been shown that strength gains from such low velocity speed training exercises (5 mph) will not manifest themselves effectively at higher velocities (15+ mph) where increased power output is necessary to improve top end (maximum) speed.
3) Method (b) requires two people to train with an elastic tether tied between both Trainees. This training method relies on the trailing training partner to be similarly conditioned and have similar speed performance capabilities. Additionally the trailing training partner must match training speeds, maintain spatial relationship and run durations with the lead runner. This makes setting training resistance highly unpredictable in addition to presenting higher probabilities of injury to the Trainees, specifically the trailing trainee who often becomes destabilized trying to maintain balance with the elastic tether pulling on them at high running velocities.

4) Training effectively to improve explosive movement and acceleration requires applying a useful load when movement is first initiated by muscular forces. The parachutes used in method (c) cannot apply any useful load when motion is first initiated by muscular force because velocity is zero and hence wind speed acting on the parachute is zero and there is no drag to generate a force at the instant the Trainee begin to accelerate which is one of the most critical points requiring loading when speed training. Additionally training load is directly proportional to running speed or wind velocity acting on the parachute. Any given Trainee may not be able to apply the desired training loads if they cannot achieve the required running velocity resulting in the required wind speed acting on the parachute to generate said desired force.

5) Method (d) described by the Wehrell "Lateral Training Apparatus" Invention is the only and most advanced form of simultaneous leg drive and swing phase loading of the four methods but the distance for which the Trainee can accelerate and try to achieve maximum running speeds is limited by the length of the elastic bands and the physical limitations of the mechanical system which handles the elastic bands. As the Trainee's distance from the apparatus increases there is still no way to maintain a constant load within tight tolerances especially when the Trainee reaches the stretch limitations of the elastic members at which point the resistance will increase exponentially as a function of distance. Once the magnitude of applied resistance surpasses a level specific to each Trainee, their running form and ability to run at all will be severely compromised and forward motion will be abruptly stopped.

The present disclosure obviates the drawbacks of the prior art.

BRIEF DESCRIPTION OF THE DRAWINGS

The following will be apparent from elements of the figures, which are provided for illustrative purposes and are not necessarily to scale.

DETAILED DESCRIPTION

Figure 1:
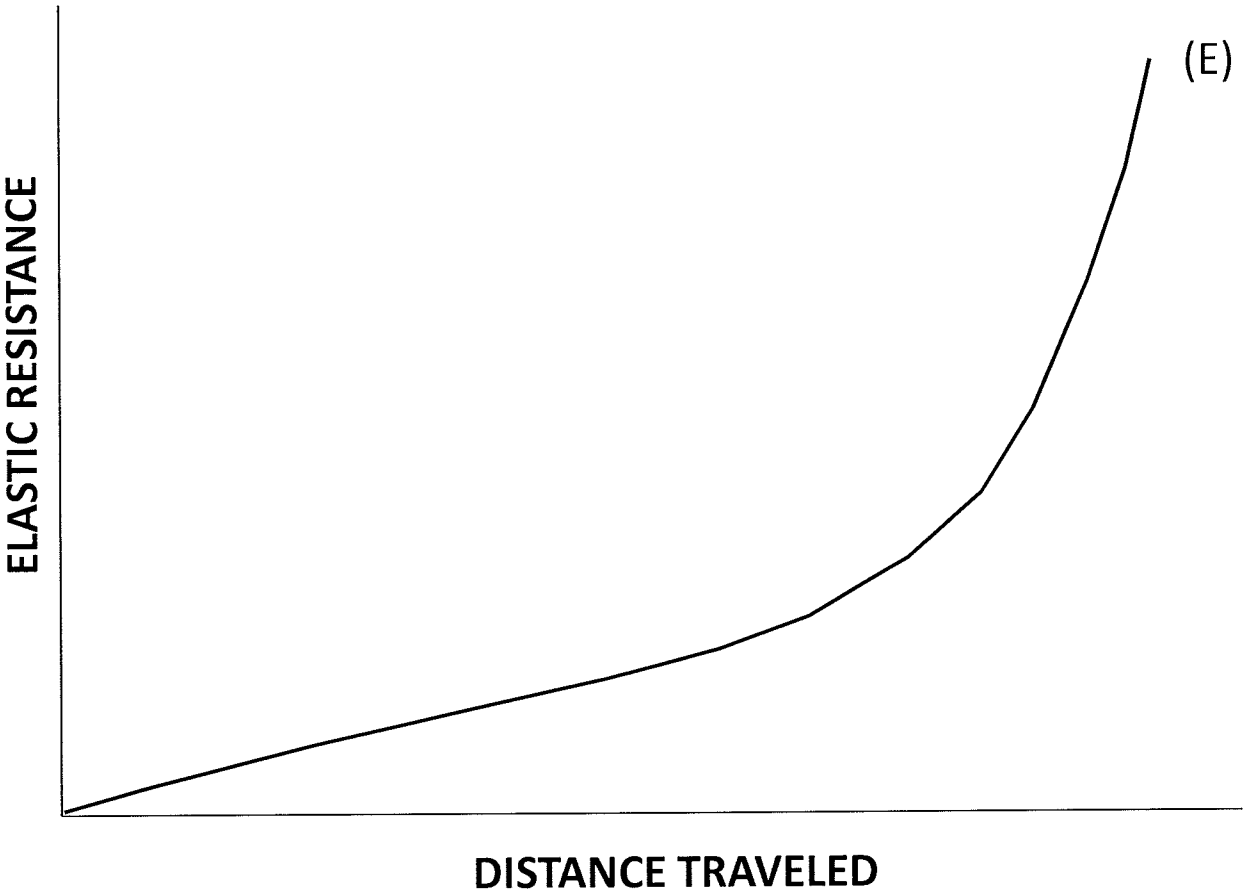
FIG. 1 (Prior Art)
FIG. 1 is a graph showing how the force required to stretch an elastic band steadily increases as a function of distance.
Figure 2:
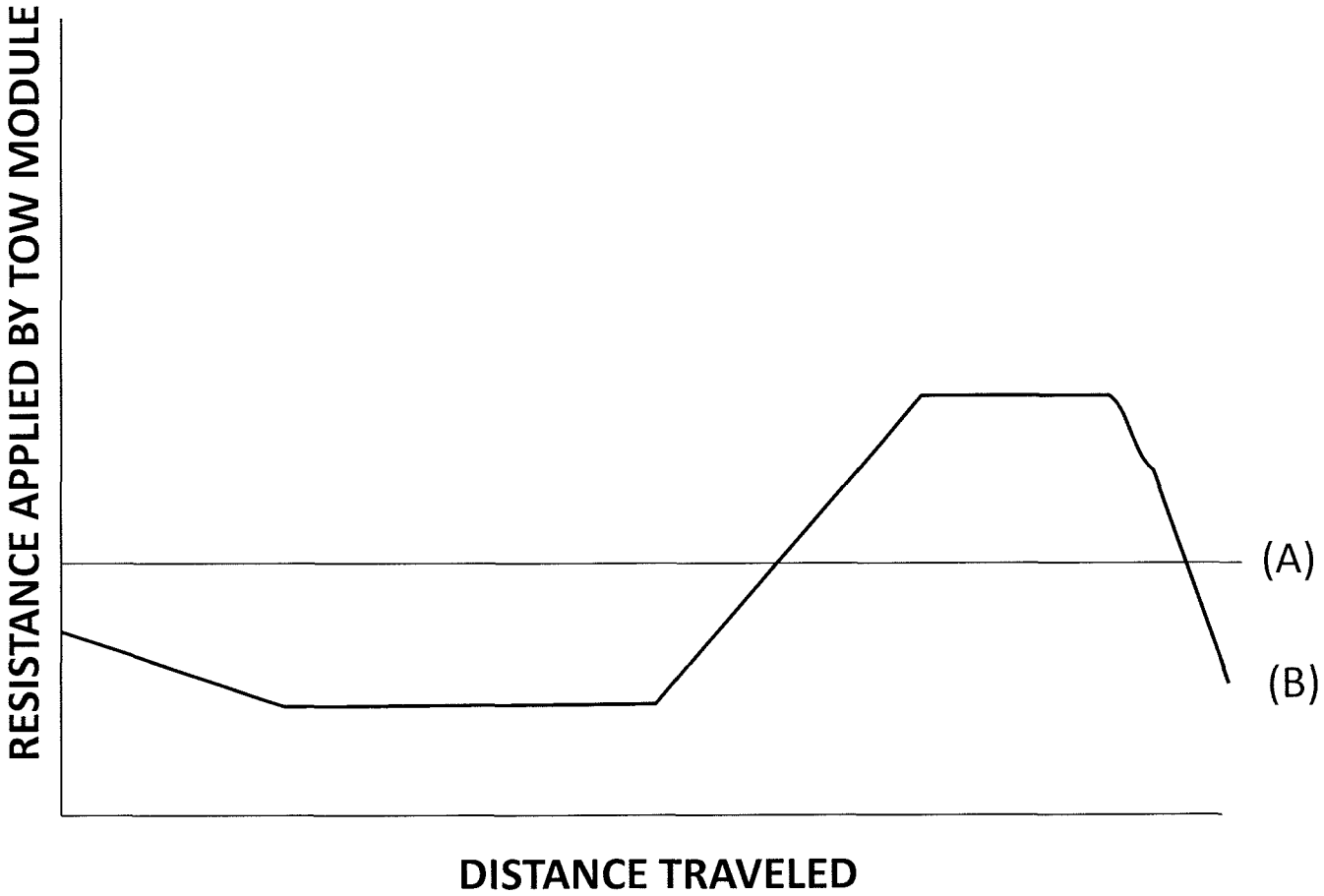
FIG. 2 is a graph showing the force per distance applied to a trainee according to one embodiment of the present disclosure.
Figure 3:
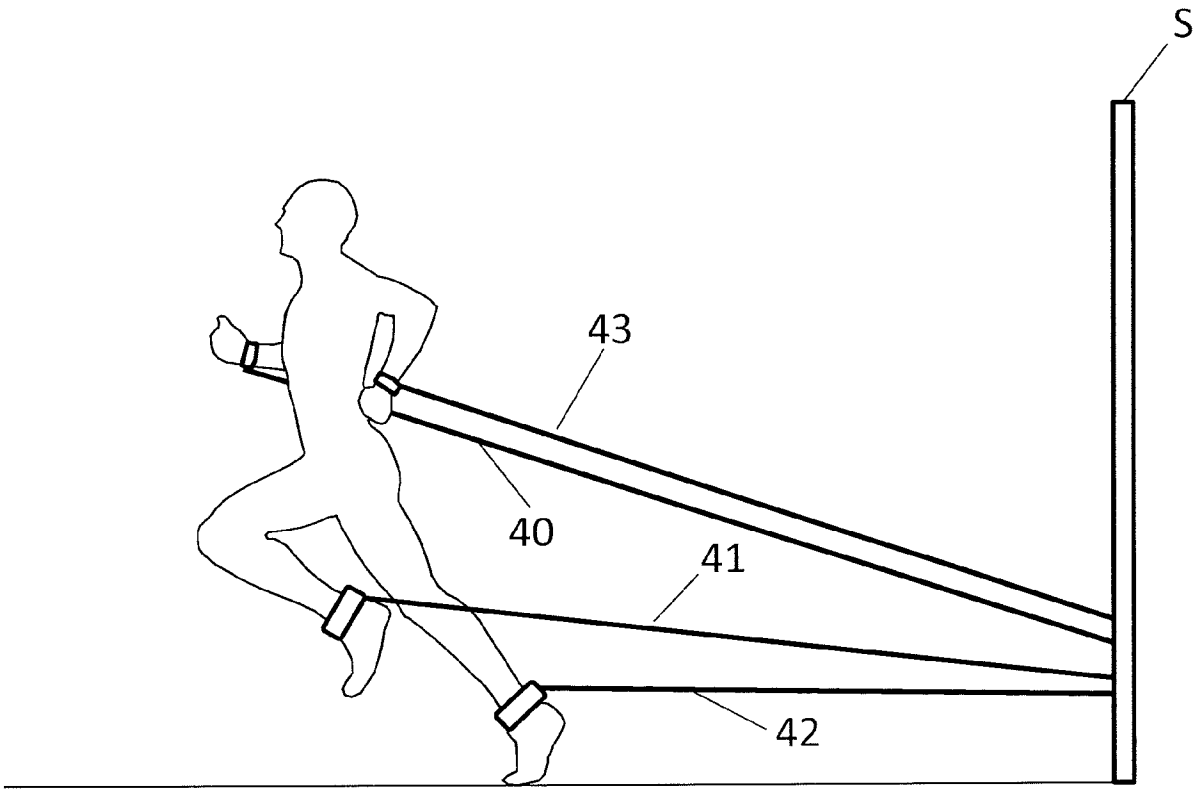
FIG. 3 (Prior Art)
FIG. 3 is a side view of an example of a prior art training setup using elastic bands to load a trainee during the act of running.
Figure 4:
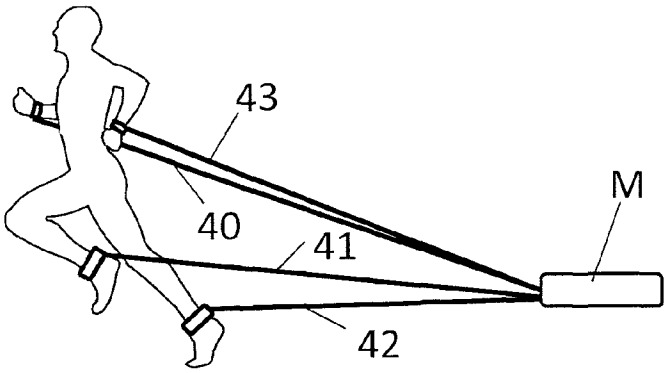
FIG. 4 (Prior Art)
FIG. 4 is a side view of an example of another prior art system.
Figure 5:
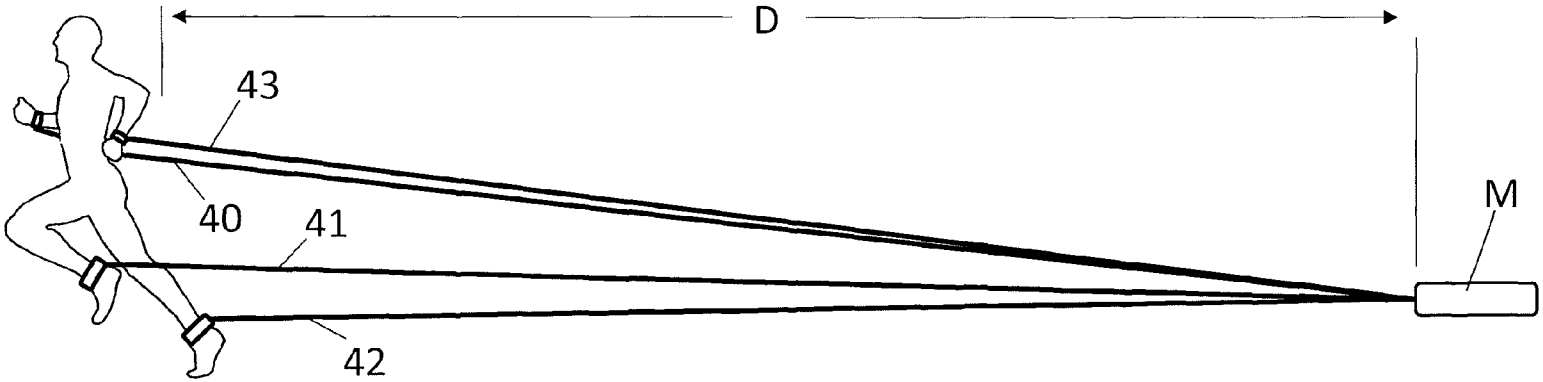
FIG. 5 (Prior Art)
FIG. 5 is a side view of the system illustrated in FIG. 4.
Figure 6:
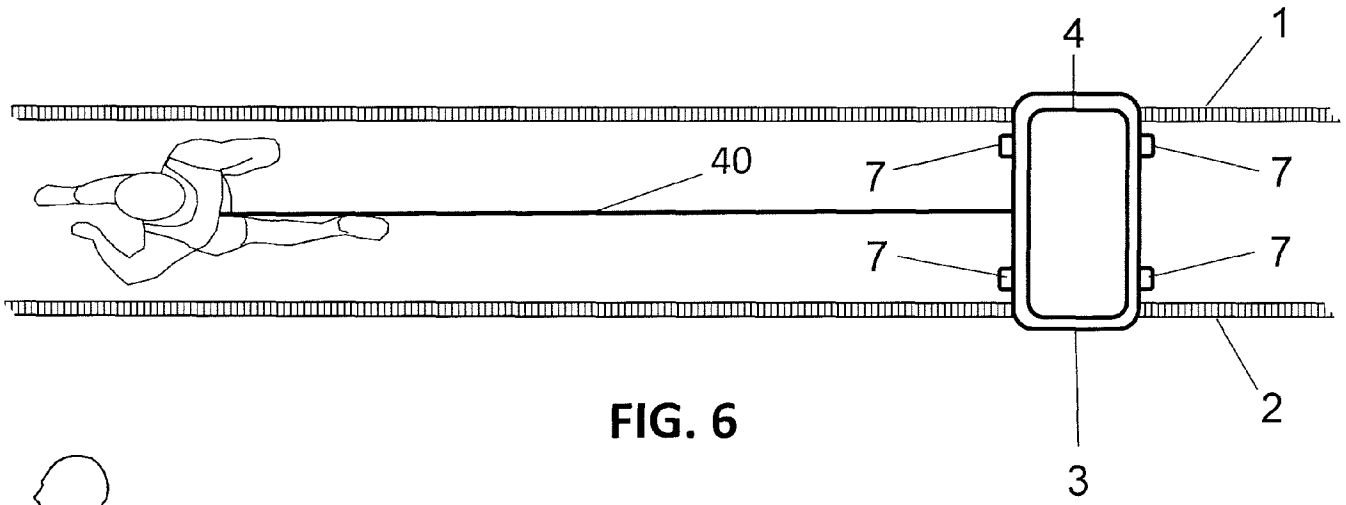
FIG. 6 shows a top view of one embodiment of the present disclosure.

With reference to the figures, like elements have been given like numerical designations to facilitate an understanding of the present disclosure which has multiple embodiments. For illustration only, certain embodiments may be described where the trainee is performing the act of running. However, the present disclosure is not limited to the act of running and provides systems and methods for training a trainee during the act of self-locomotion by any mode.

FIGS. 6-12 illustrate one embodiment of the present disclosure. In this embodiment, the self-locomotion training system includes a mobile training module 3; a pair of coupling belts 1,2; resistance loading module 4; and tethers 40-43. The mobile training module 3 carries the braking/drive element 6 coupled to drive belts 1,2. The braking/drive element 6 may include means to measure velocity and receive and process data indicating the level of applied resistance to the trainee from controller 5 and provided automatic control of the magnitude of the resistance load by adjusting the breaking load applied to the drive belts 1,2. Braking element 6 may also create resistance to the movement of the mobile training module 3 using mechanical braking means such as disk brakes acting on the coupling device with the drive belts 1,2.

In another embodiment, the braking/drive element 6 may provide wind resistance derived from a rotating wheel with variable pitched blades. The wheel within element 6 that is coupled to element 1 and/or 2 will spin when element 3 is pulled. The variable pitched blade positions (on the spinning wheel coupled to the drive belts) will be controlled either manually or by an electric servo. By altering the pitch of the blades the wheel it will be possible to alter the force required to drive the blades (which are attached to the wheel) through the air and thus alter the required force to tow mobile training module 3. The electric pitch control servo can be programmed to change resistance based on mobile training module 3 velocity, distance traveled or resistance applied to the Trainee.

The braking/drive element 6 may also include a drive motor coupled to drive belts 1,2 so that electromechanical braking and drive capability is included in the mobile training module 3. Self-propulsion with programmable means will provide the mobile training module 3 with the ability to compensate for the mass of the module when the trainee accelerates so that the mobile training module 3 may accurately maintain a specified resistance load on the trainee without the mass of the module affecting the applied resistance during acceleration.

Data connectivity between elements 5 and 6 enable programmable means to apply fixed or varying resistance to the trainee. The applied resistance controlled by the interaction of elements 5, 6, 1 and 2 may be controlled such that the resistance applied to the trainee is maintained independent of acceleration, deceleration or velocity. The combined capabilities of elements 3 and 4 will have the capability to alter resistance acting on the trainee as a function of distance traveled, velocity, and acceleration or deceleration of the trainee. A separate hand held programmable means may also be used to communicate with and program resistance settings and other variables prior to and during the training.

Figure 7:
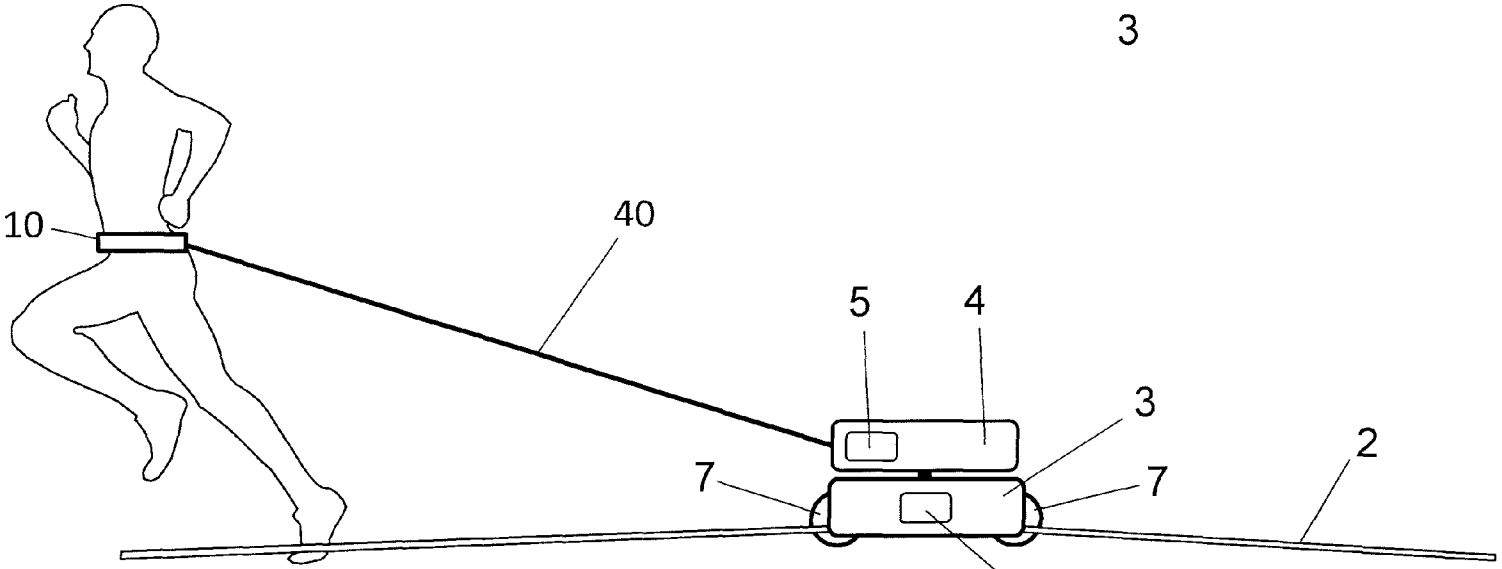
FIG. 7 is a side view of the embodiment illustrated in FIG. 6.
Figure 7A:
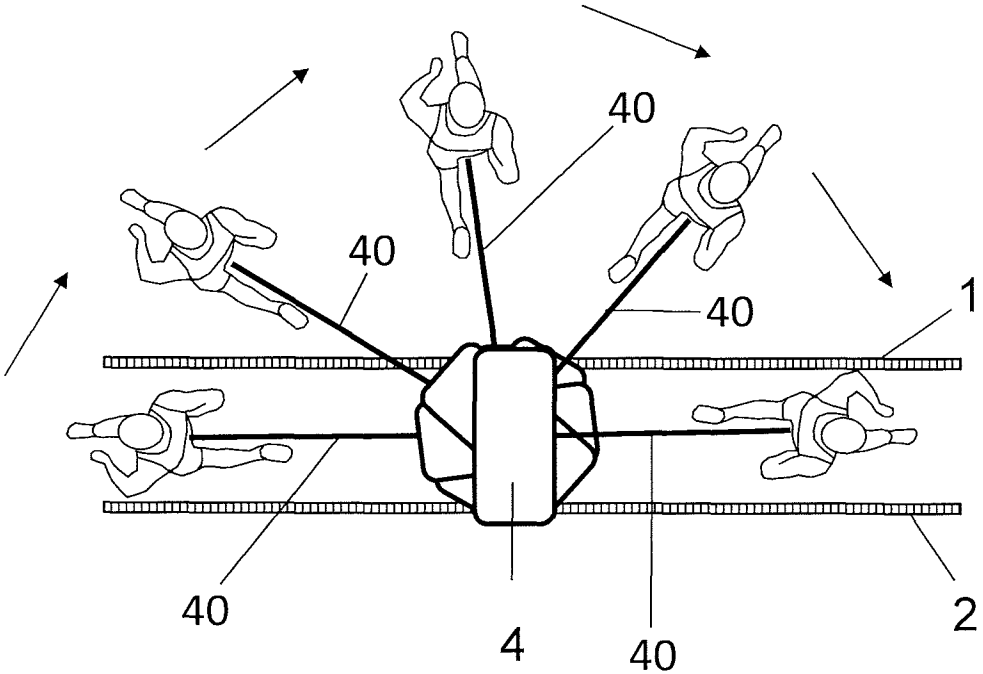
FIG. 7A shows a top view of the embodiment illustrated in FIG. 7.
Figure 8:
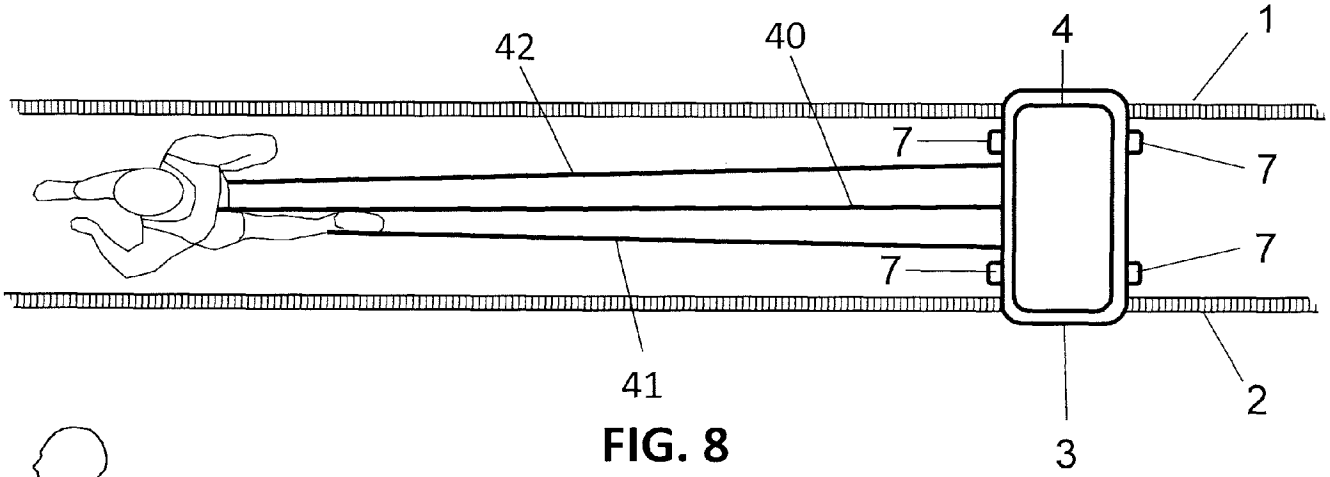
FIG. 8 is a top view of another embodiment of the present disclosure.
Figure 9:
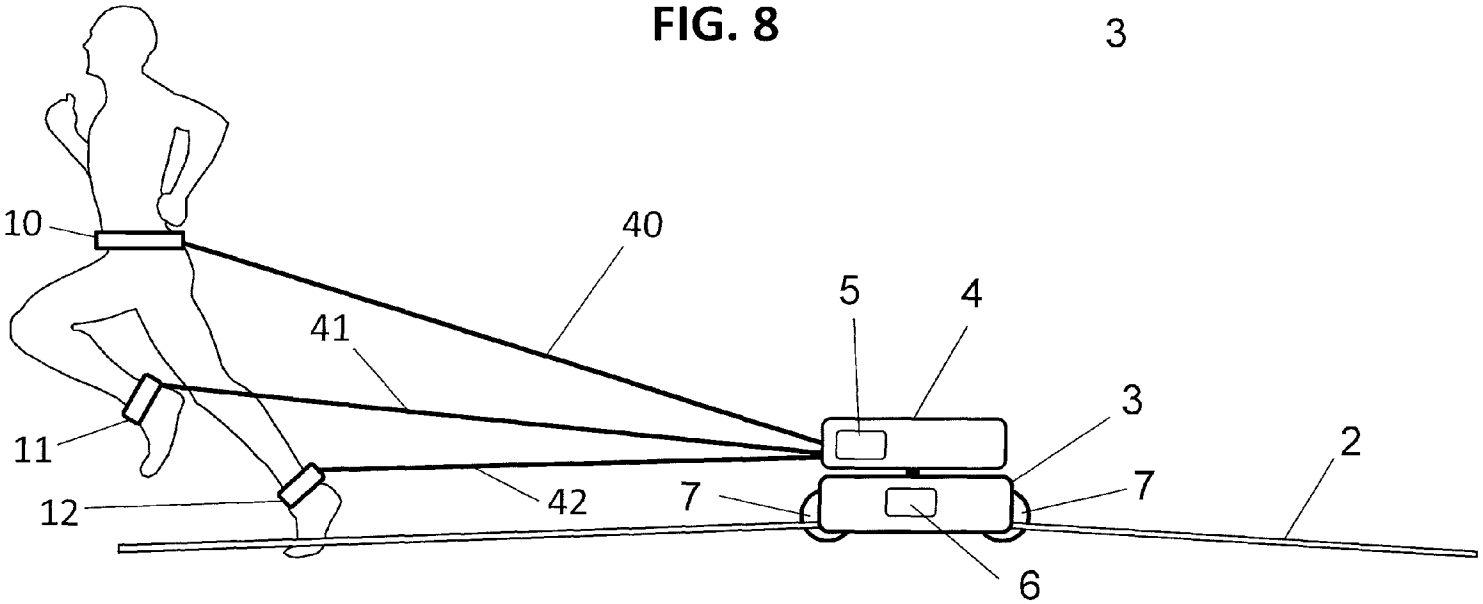
FIG. 9 is a side view of the embodiment illustrated in FIG. 8.
Figure 10:
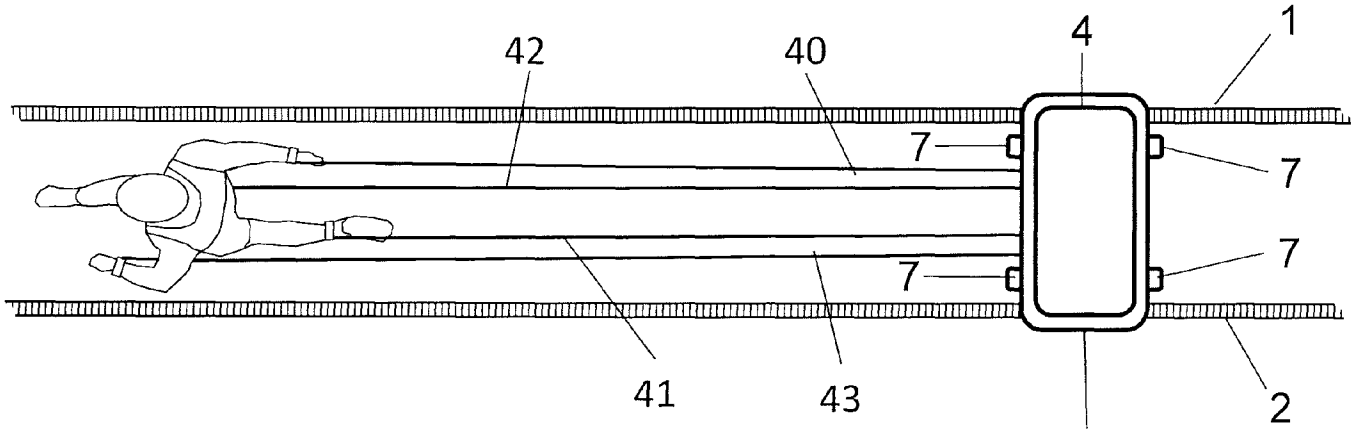
FIG. 10 is a top view of another embodiment of the present disclosure.
Figure 31:
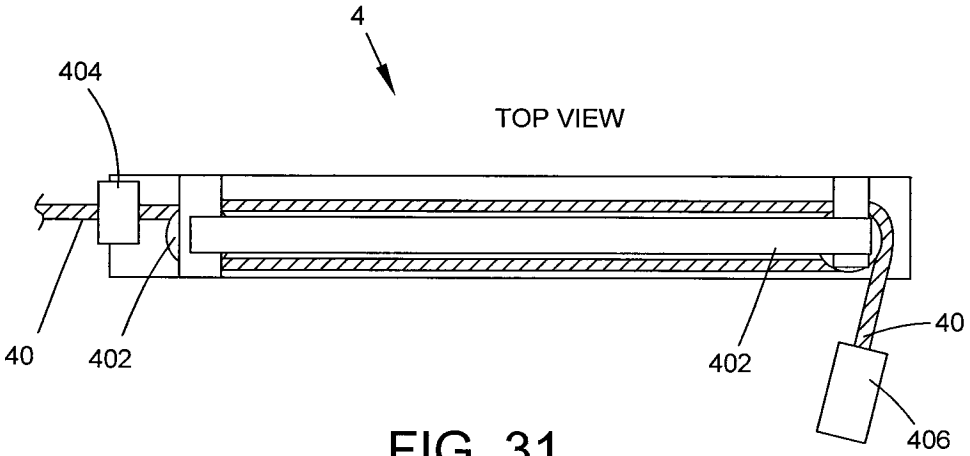
FIG. 31 is a top view of another embodiment of the present disclosure.
Figure 32:
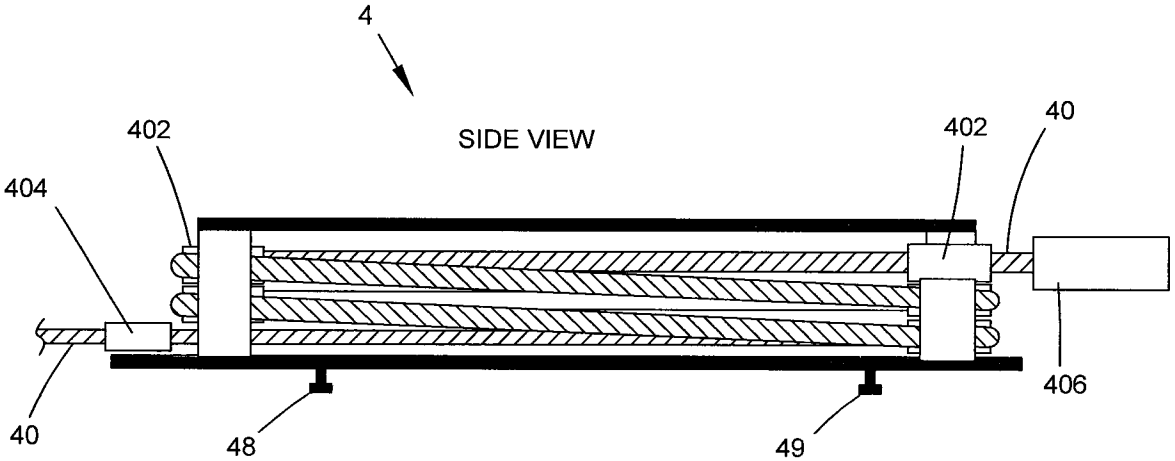
FIG. 32 is a side view of the embodiment illustrated in FIG. 31.

Resistance loading module 4 may contain one or more elastic tethers 40-42. Module 4 contains tracking means allowing the tethers 40-42 to retract into the module 4 when the trainee is no longer applying force to the tethers. As shown in more detail in FIGS. 31 and 32, module 4 contains a plurality of tracking members 402 that direct tether 40 from one end secured by an anchor 404 to a free end 406 that is adapted to be connected to a selected portion of a trainee. Module 4 may also swivel 360 degrees relative to the mobile training module 3 to allow the trainee to reverse direction as shown in FIG. 7A and run in the opposite direction between drive belts 1,2 without having to disconnect the mobile training module 3 from the drive belts 1,2 and turn it around for training in the other direction. The pivoting feature is most applicable when using the linear embodiment utilizing predetermined fixed straight-a-ways shown in FIGS. 6-12. As shown, the coupling belts 1,2 provide a physical fixed reference (portable or fixed with respect to the training surface) to define a training path.

The mobile training module 3 may include a sliding surface for sliding over the training surface, or it may include one or more wheels 7 to facilitate movement of the module 3 along over the training surface 200. The module 3 may include any number of wheels.

Figure 11:
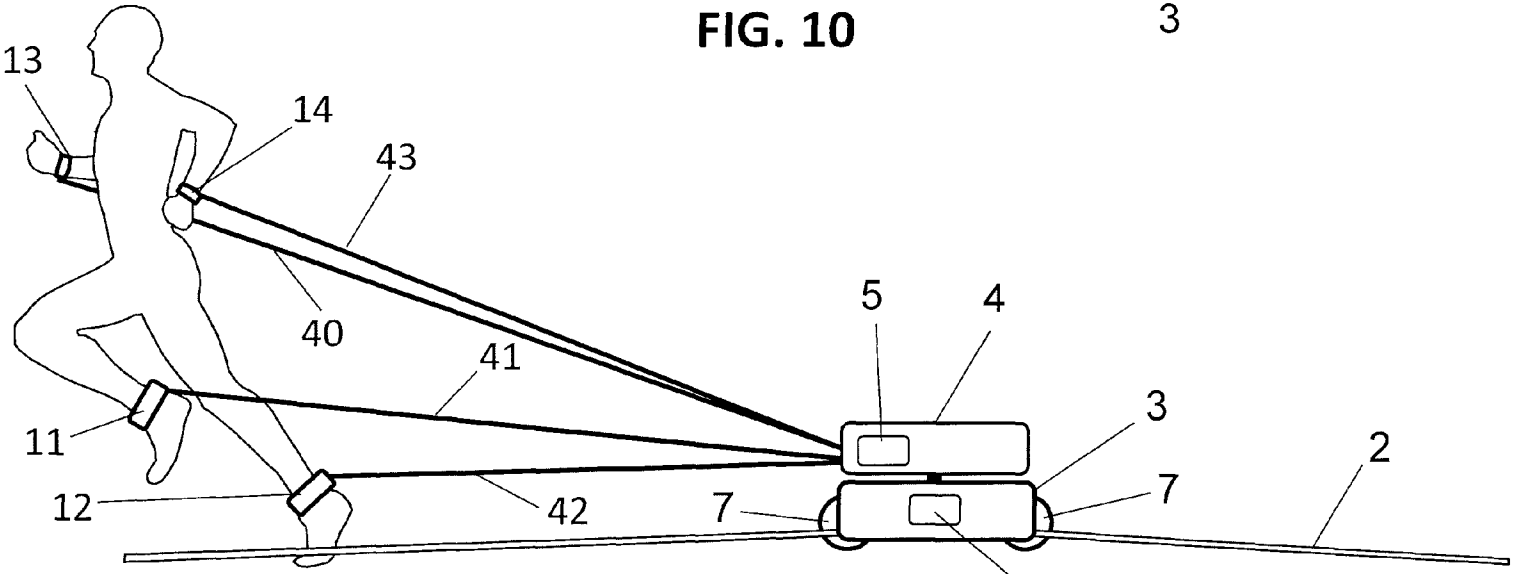
FIG. 11 is a side view of the embodiment illustrated in FIG. 10.
Figure 12:
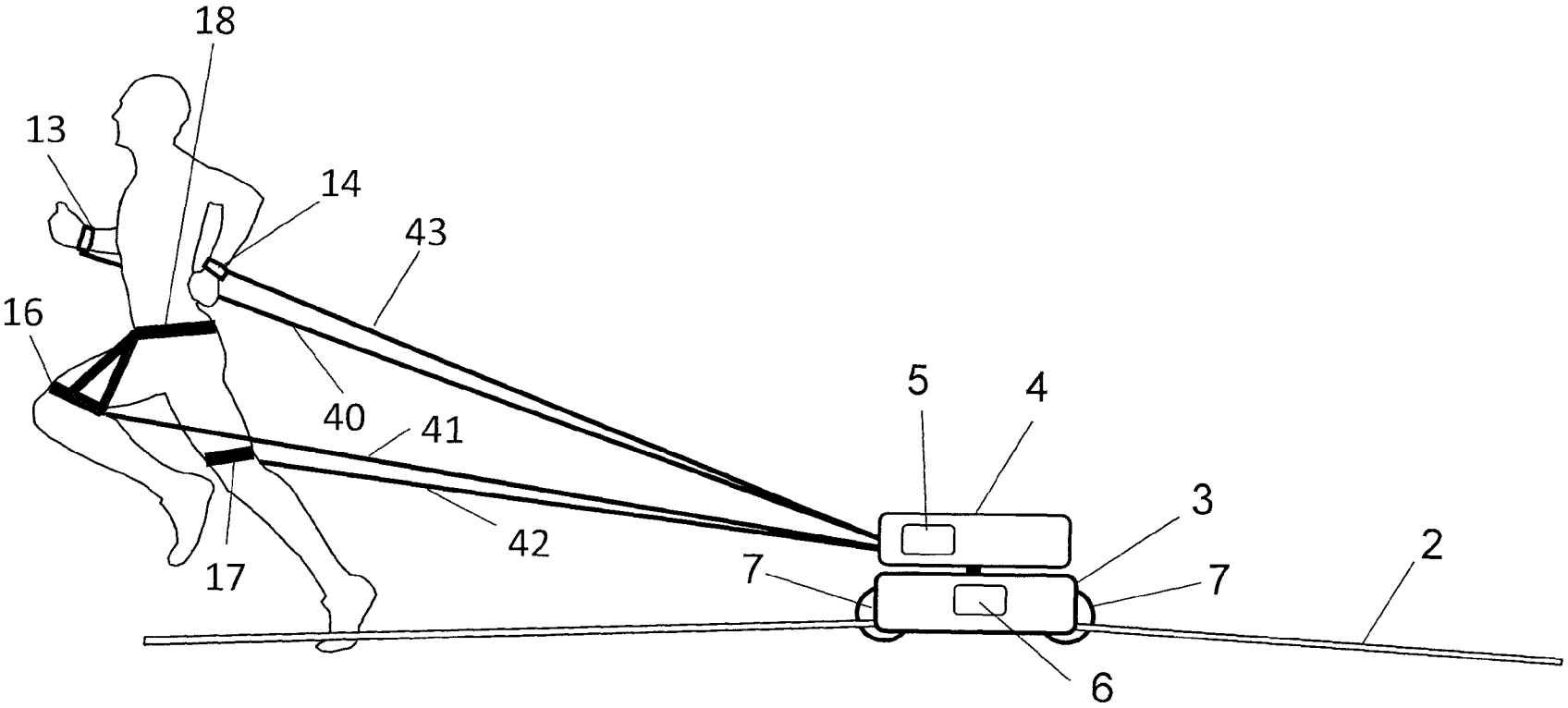
FIG. 12 is a top view of another embodiment of the present disclosure.

The tethers may be connected to the trainee by harnesses 10-17 at selectable body portions such as the waist, wrists, thighs and ankles. For illustrative purposes FIG. 11 shows harnesses 13 and 14 providing means to attach tethers 43 and 40 to the trainee's wrists to provide resistance against forward motion of the arm when running or walking. FIG. 12 shows attachment means 16 and 17 consisting of harnesses that fit around the thigh and are supported by a waist belt 18. Rear connecting means on harnesses 16 and 17 allow tethers 41 and 42 to connect just behind the knee.

Figure 13:
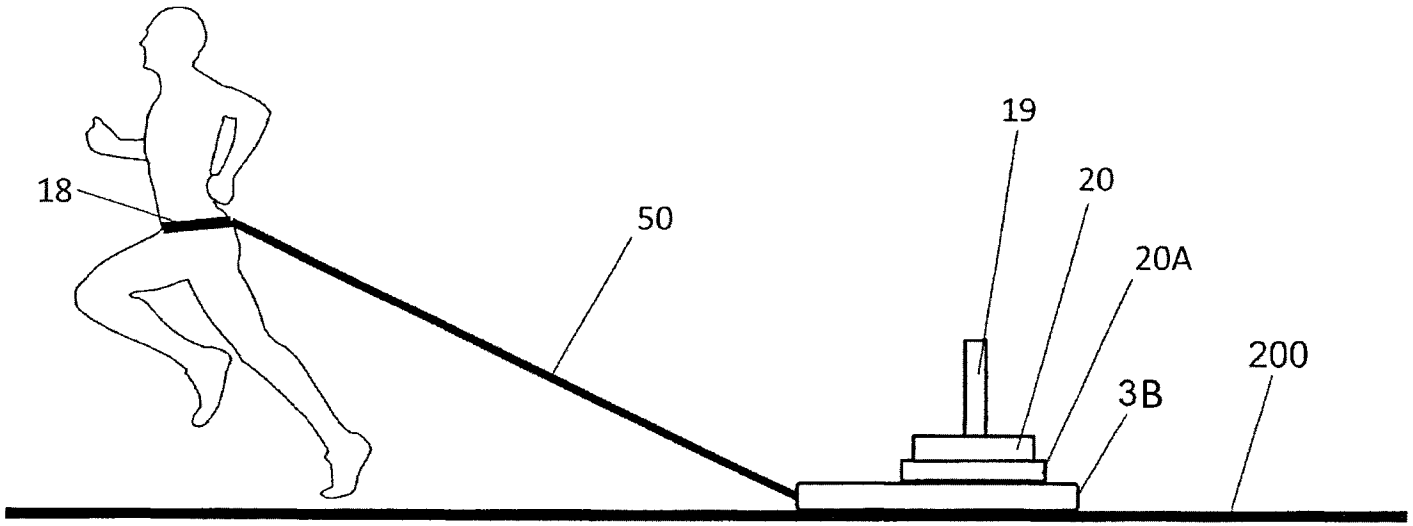
FIG. 13 (Prior Art)
FIG. 13 is side view of a prior art training system.

FIG. 13 illustrates a prior art system that tethers a weighted mobile sled 3B to a trainee with tether 50. Weights 20 and 20A are stacked on post 19 to provide weight to the sled 3B. When the trainee pulls the sled, friction between the sled 3B and training surface 200 provide training resistance which is transferred to the trainee by tether 50. The prior art illustrated in FIG. 13 only loads the drive phase (pushing muscles when foot is in contact with ground) of the act of self-locomotion.

Figure 14:
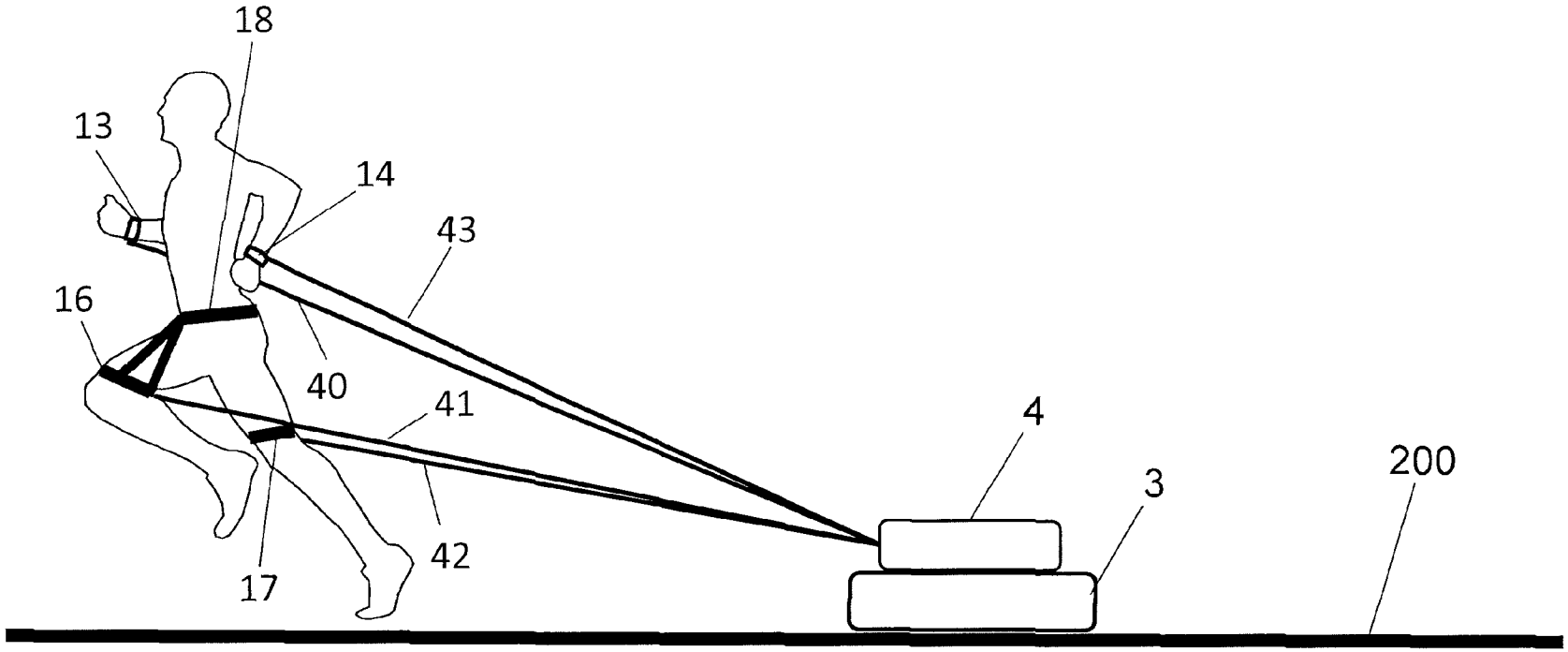
FIG. 14 is a side view of another embodiment of the present disclosure.

FIG. 14 shows another embodiment of the present disclosure where resistance loading module 4 is carried by a mobile training module 3 (a sled in this embodiment) designed to be pulled over the training surface 200. One or more elastic bands 40-43 may be attached to the trainee with harnesses. As the trainee begins to run, the elastic bands 40-43 begin to stretch and apply a composite load to the trainee that increases as a function of the distance travelled by the trainee. When the composite force from all tethers exceeds the frictional force between the mobile training module 3 and the training surface 200, the mobile training module 3 will move and follow the trainee. Module 4 maintains the tension on the elastic tethers 40-43 relatively constant so that the velocity of the mobile training module 3 and the trainee reach a state of equilibrium and the mobile training module 3 will remain at a relatively fixed distance behind the trainee loading the leg drive and recovery phases and/or arm drive for as long as the trainee runs.

Figure 15:
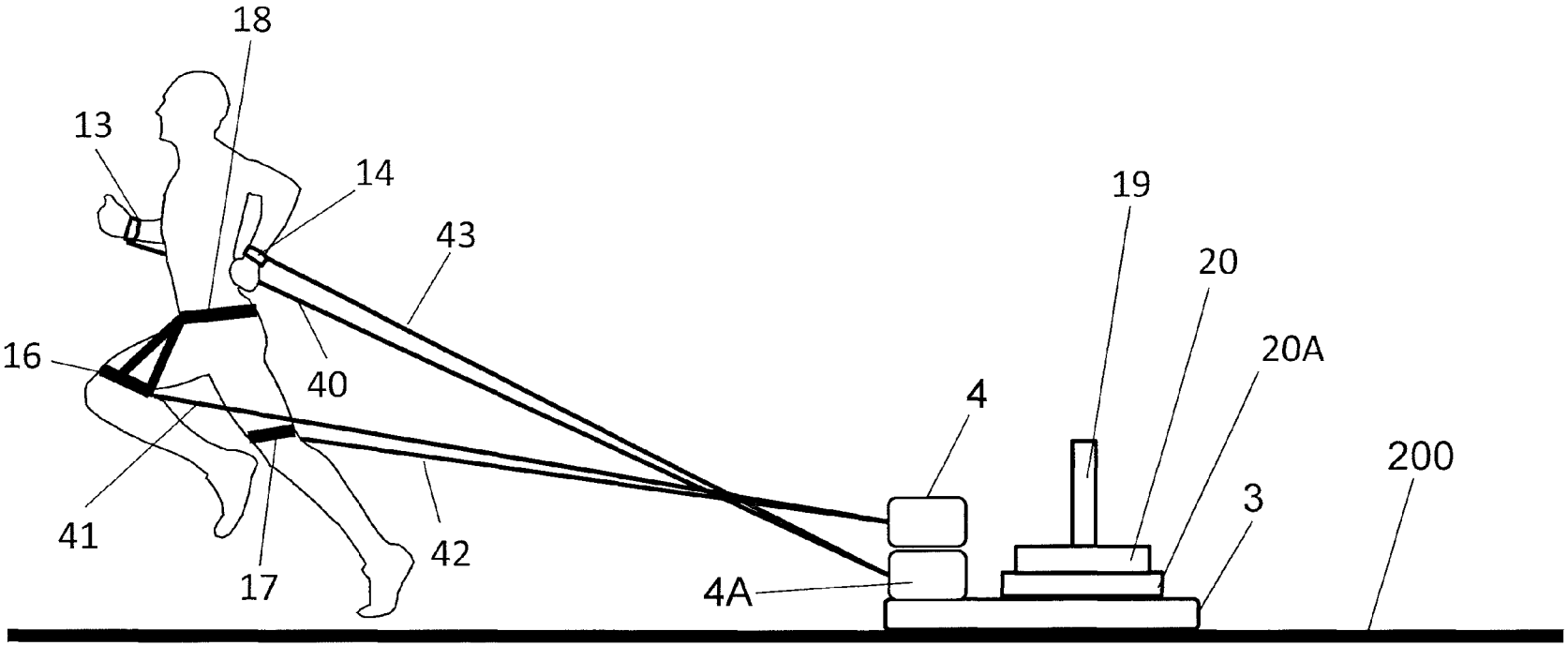
FIG. 15 is a side view of another embodiment of the present disclosure.

FIG. 15 shows how multiple resistance modules 4 and 4A (elastic resistance modules with internally routed retractable elastic bands) may be stacked and carried by mobile training module 3 so that it can load the drive and recovery phases of running in addition to loading arm drive.

Figure 16:
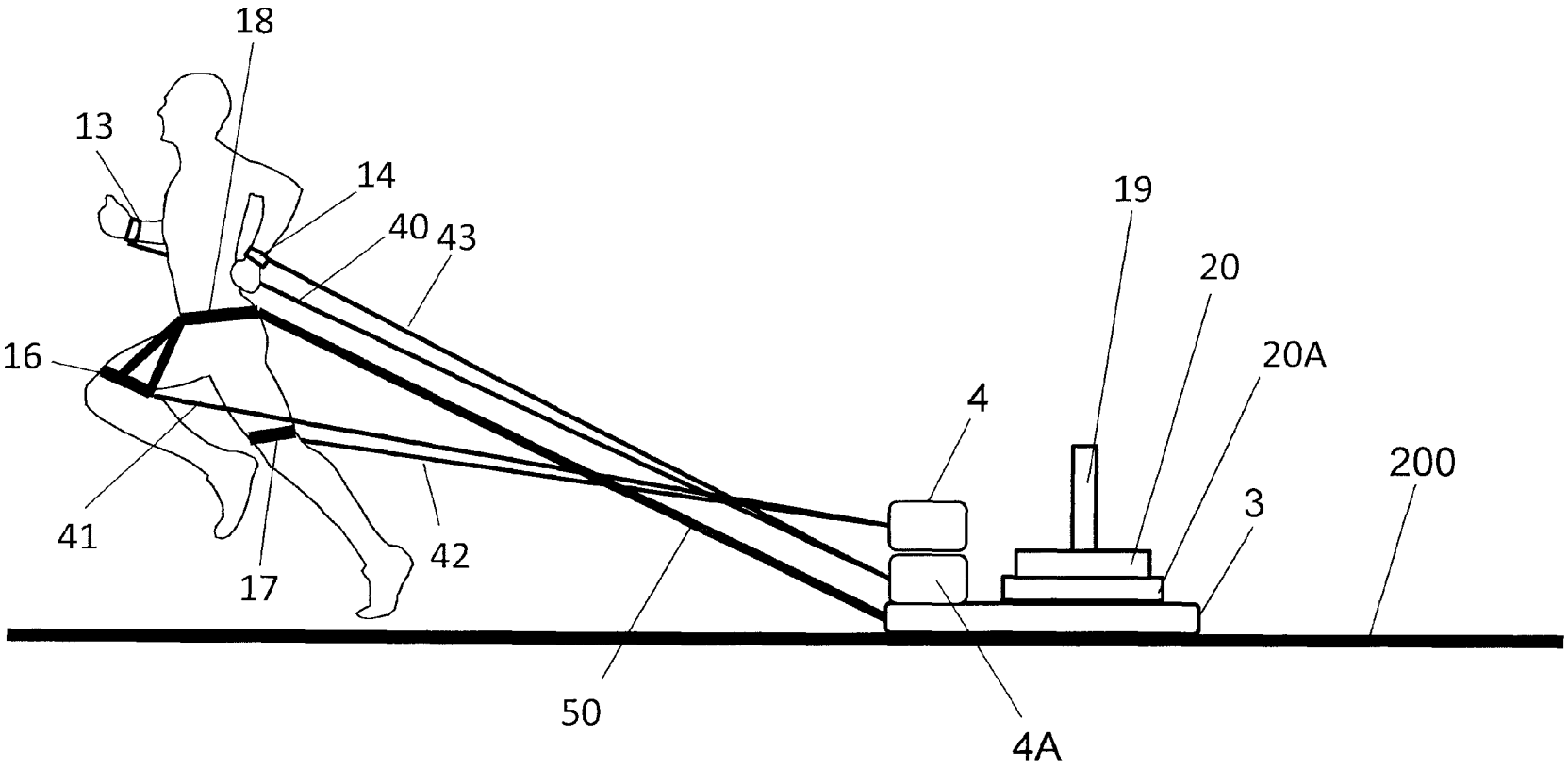
FIG. 16 is a side view of another embodiment of the present disclosure.

FIG. 16 adds a heavy elastic or non-elastic or combination of elastic and non-elastic tether 50 between the trainee's waist and mobile training module 3 as a means to provide a larger pulling force on the mobile training module so that it can begin moving. Attachment 50 will allow mobile training module movement to not be so dependent on the composite force from tethers 40-43.

Figure 17:
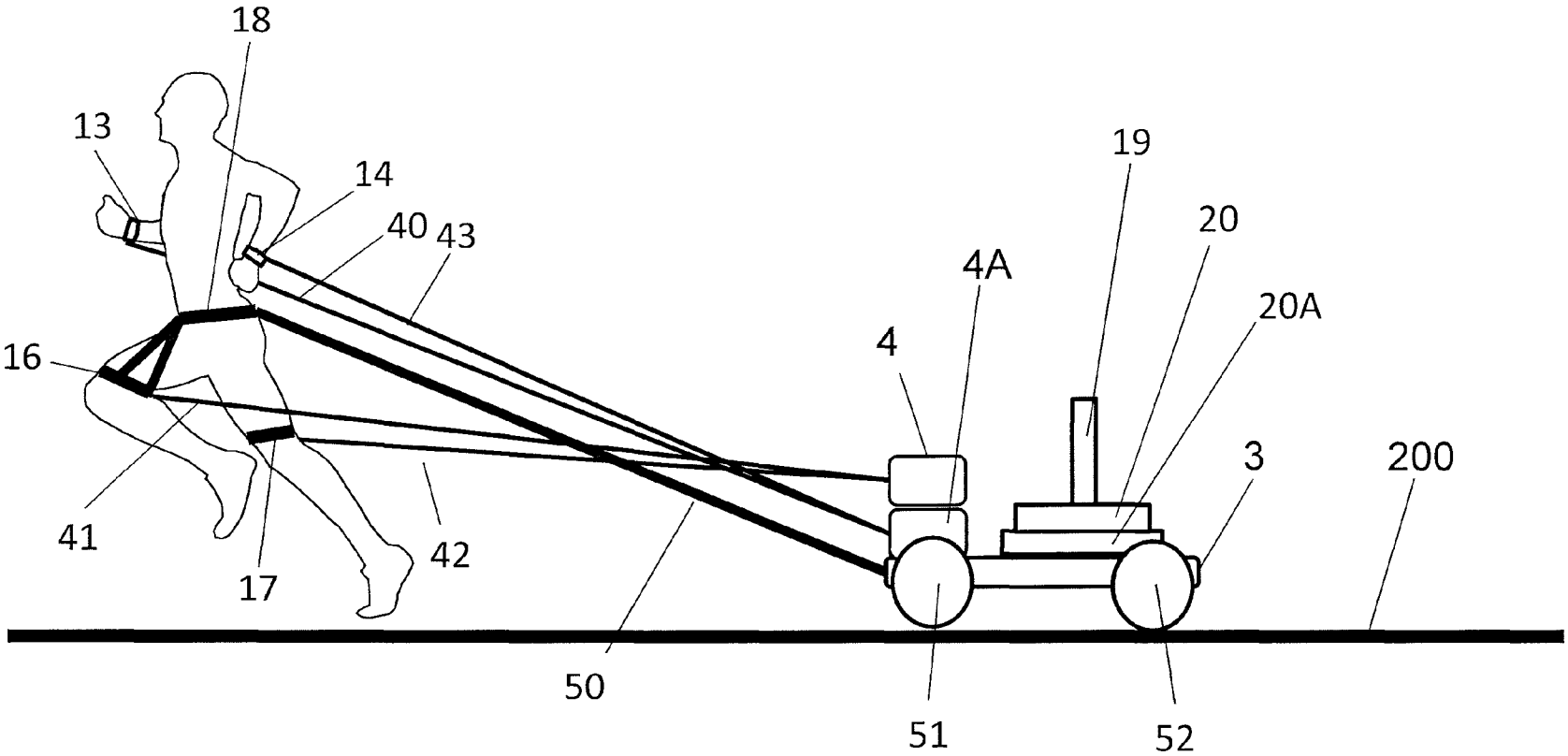
FIG. 17 is a side view of another embodiment of the present disclosure.

FIG. 17 illustrates another embodiment of the disclosure whereby wheels 51,52 are attached to the mobile training module 3. The tether 50 connects at one end to the waist harness 18 worn by the trainee and connects at the other end to a steering mechanism (not shown) for steering the mobile training module 3.

This embodiment allows the trainee to travel along a training path that is not linear such as an oval track while the mobile training module 3 shadows the trainee along the training path. Thus the embodiment illustrated in FIG. 17 includes no distance limitations.

Figure 17A:
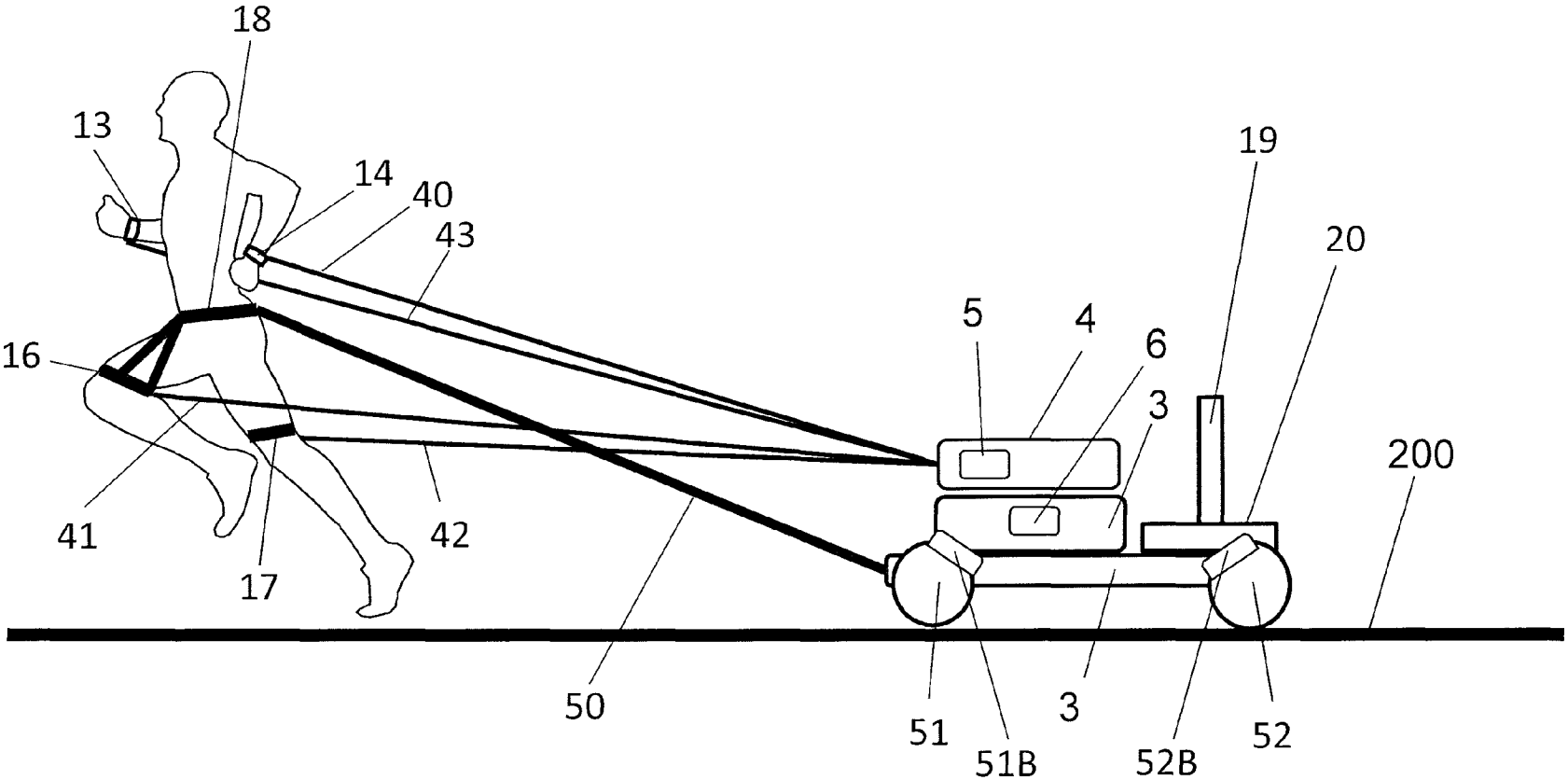
FIG. 17A is a side view of another embodiment of the present disclosure.

FIG. 17A illustrates another embodiment including elements 3, 4, 5 and 6 which function as described in related FIGS. 6-12. Element 6 may serve as an electro-mechanical braking system controlling wheel brake elements 51B and 52B to generate drag resistance to be applied to the trainee primarily by tether 50. Element 5 monitors individual training resistance applied by tethers 40-43 or the composite resistance applied by all tethers and transmits resistance data to element 6 which controls drag resistance by engaging brakes 51B and 52B.

Element 6 can have additional capabilities such as the ability to not only brake but electromechanical means or gas powered means to drive wheel sets 51 and 52 so mobile training module 3 can be propelled.

Figure 18:
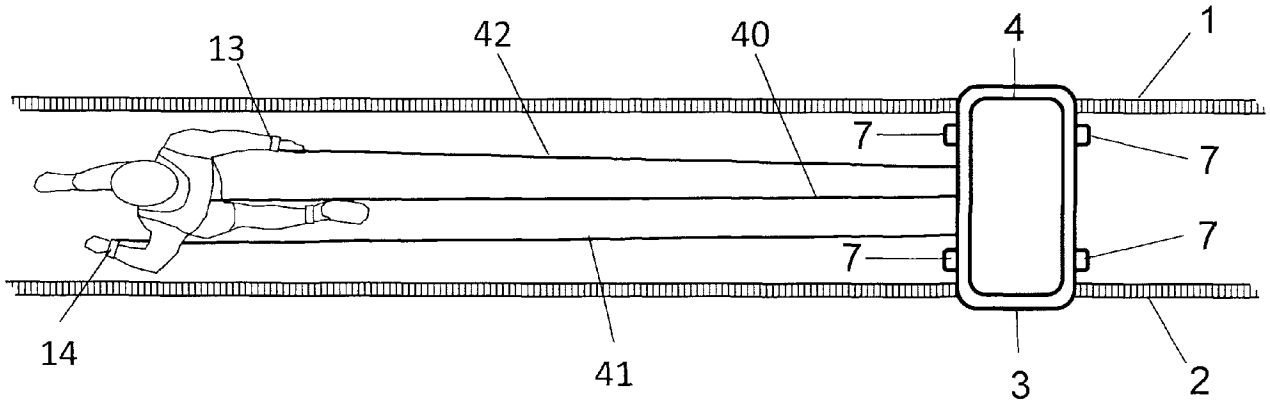
FIG. 18 is a top view of another embodiment of the present disclosure.
Figure 19:
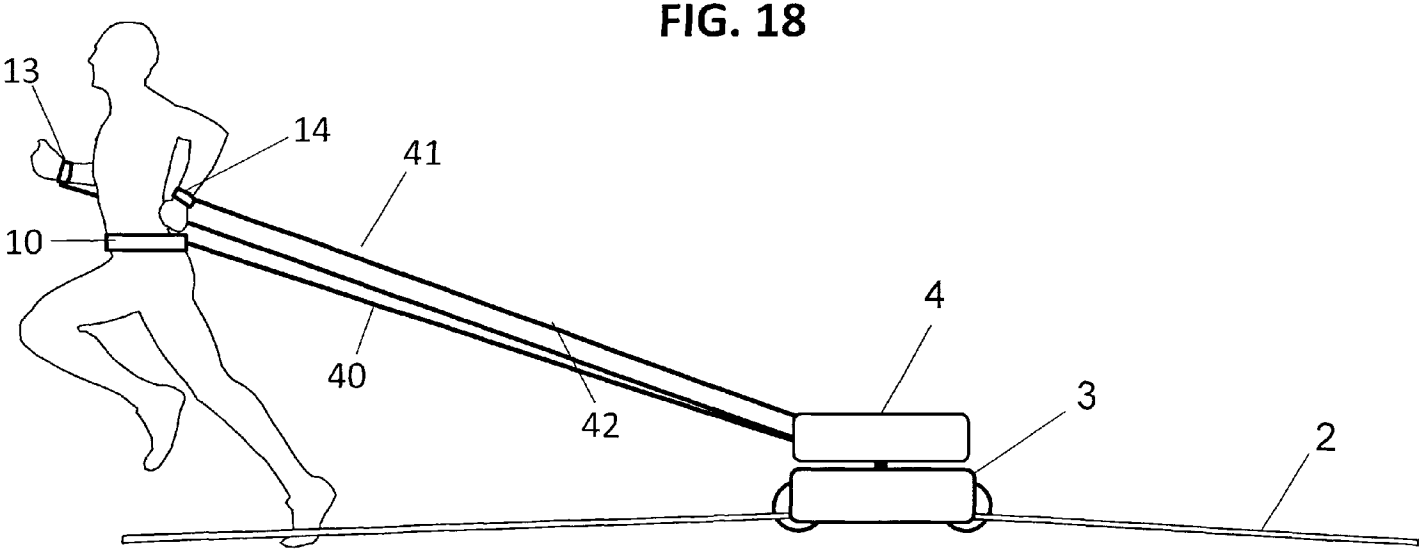
FIG. 19 is a side view of the embodiment illustrated in FIG. 18.

FIG. 18 shows a top view of a three tether loading configuration applying resistance to the waist and arm drive. This particular loading configuration loads the leg drive phase and forward arm drive. FIG. 19 is a side view of the FIG. 18 configuration.

Figure 20:
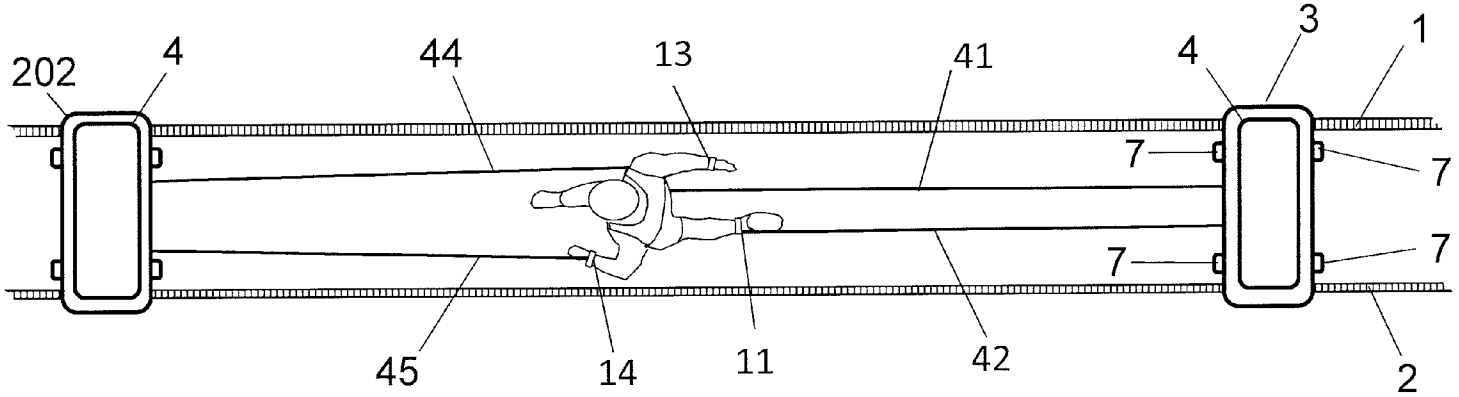
FIG. 20 is a top view of another embodiment of the present disclosure.
Figure 21:
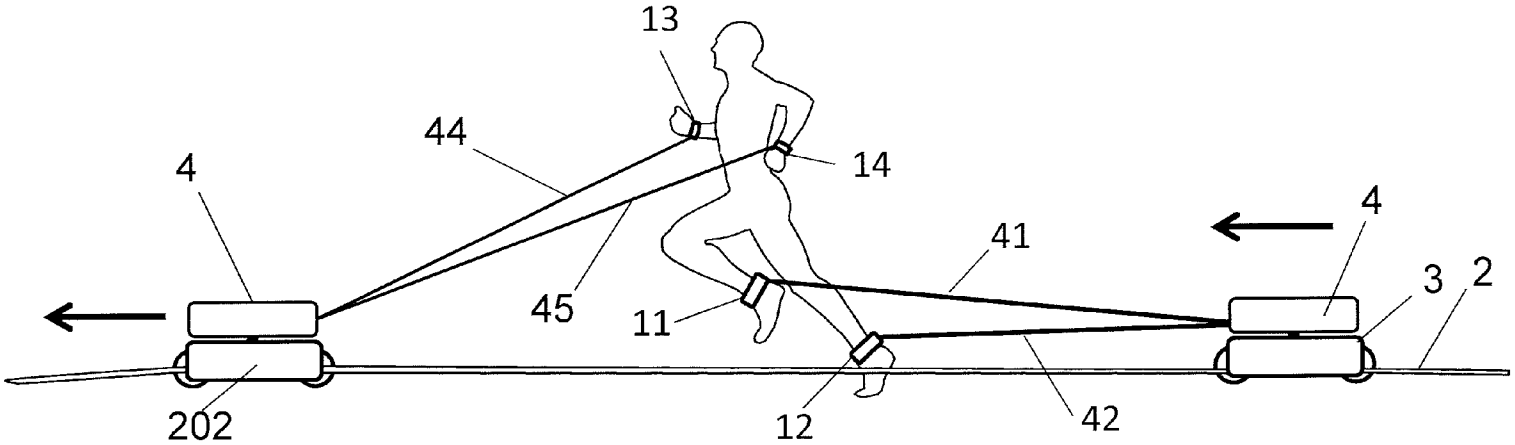
FIG. 21 is a side view of the embodiment illustrated in FIG. 20.

FIG. 20 is another embodiment of the present disclosure that utilizes a second mobile training module 202 used in the propulsion mode. Mobile training module 202 propels itself in front of the trainee pulling tethers 44 and 45 so that the tethers resist the rearward driving movement of the arms as the trainee runs. Synchronization of velocity between the two mobile training modules is accomplished by mobile training module 202 receiving velocity information from mobile training module 3 by radio transmission and mobile training module 202 then uses the mobile training module 3 velocity information to control its propulsion system. The embodiment illustrated in FIG. 20 loads the leg swing phase and also resists the rearward driving movement of the arms simultaneously. FIG. 21 is a side view of the embodiment illustrated in FIG. 20.

Figure 22:
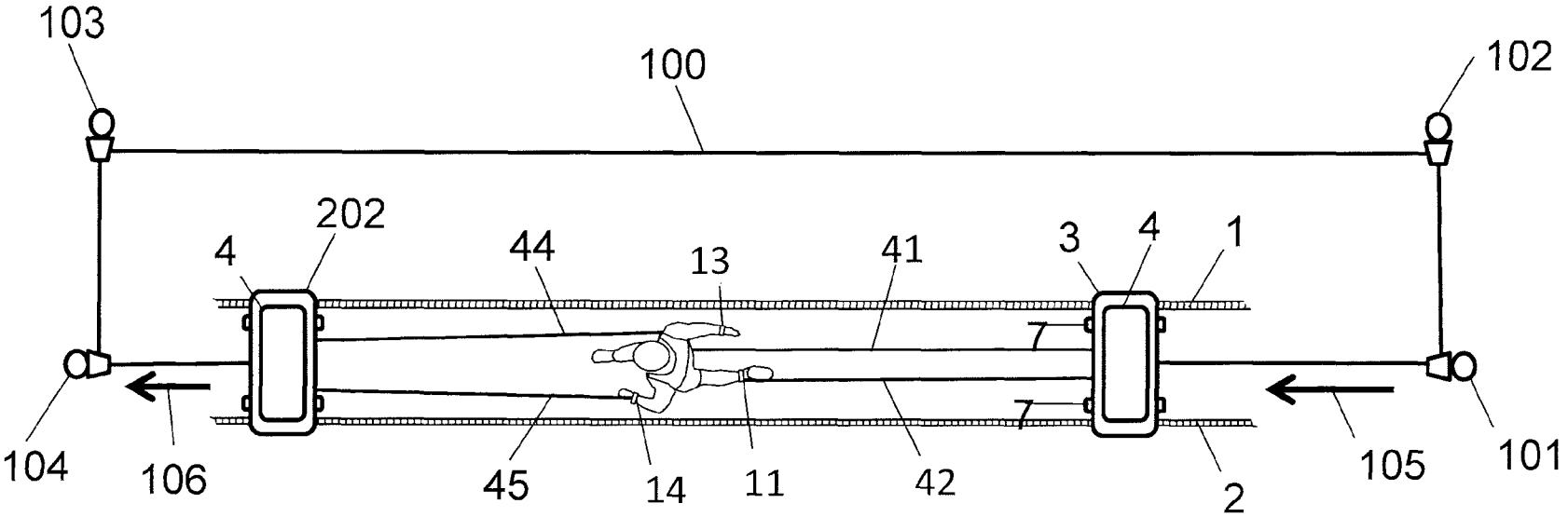
FIG. 22 is a top view of another embodiment of the present disclosure.

FIG. 22 shows a top view of an embodiment of the system which does not require mobile training module 202 to have a propulsion system. By connecting a cable 100 between the rear of mobile training module 3 and the front end of mobile training module 202 and routing cable 100 through anchored pulleys 101-104 it will be possible to for the propulsion system in mobile training module 4 to also drive mobile training module 202 and match velocities exactly due to the non-elastic cable 100 connecting the two mobile training modules. If mobile training module 3 moves forward one foot then mobile training module 20 also moves forward one foot.

Figure 23:
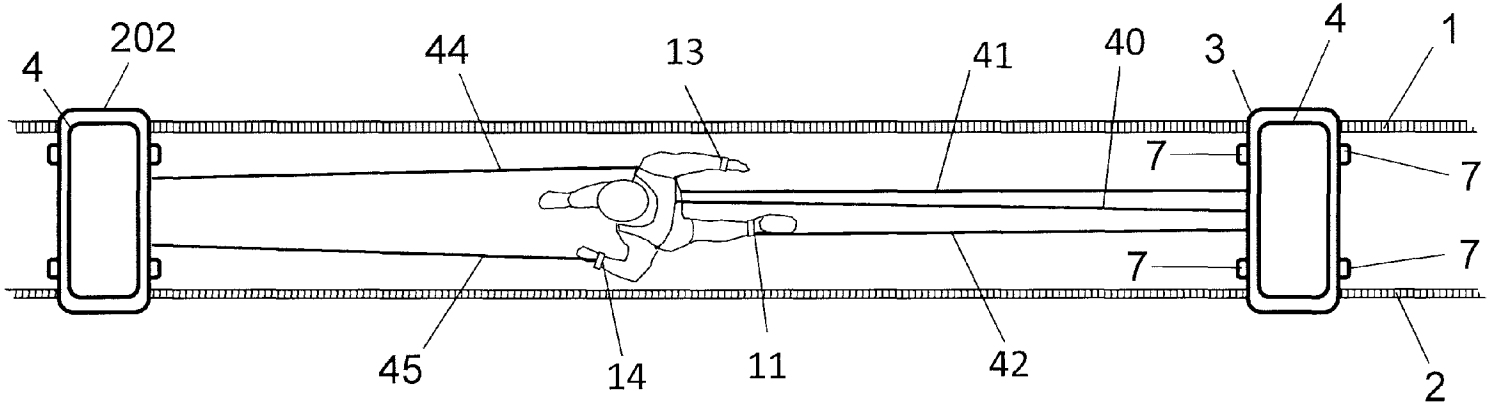
FIG. 23 is a top view of another embodiment of the present disclosure.
Figure 24:
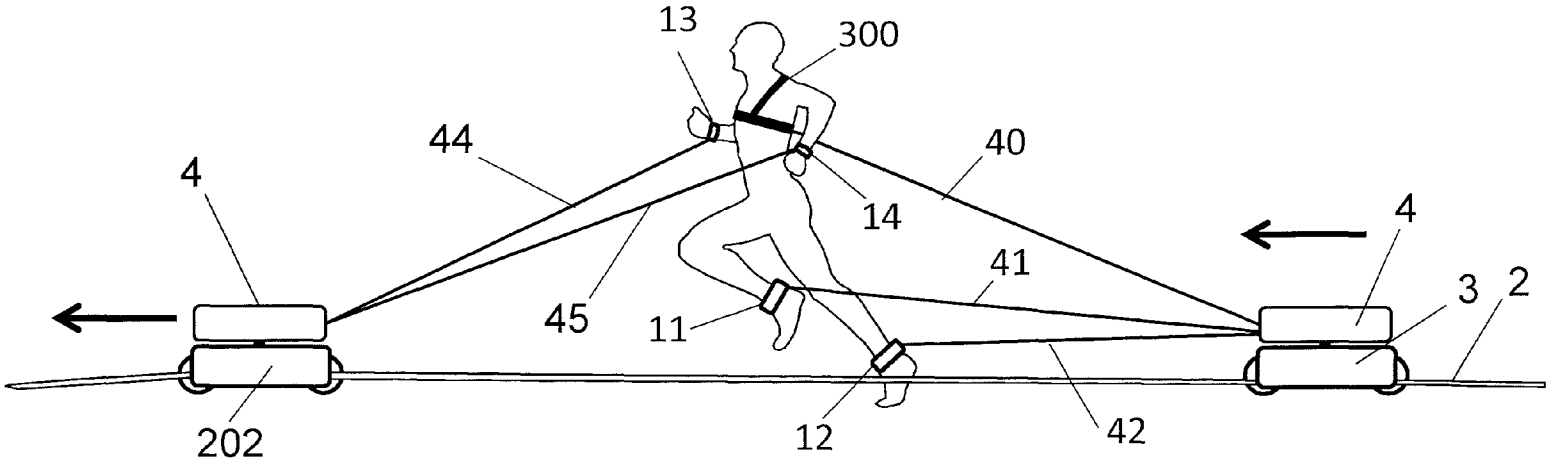
FIG. 24 is a side view of the embodiment illustrated in FIG. 23.

FIGS. 23 and 24 illustrate another embodiment including resistance tether 40 and attaching it to harness 300 to assist in stabilizing the trainee by using the resistance of tether 40 to counteract the composite resistance from tethers 44 and 45 pulling the trainee forward.

Figure 25:
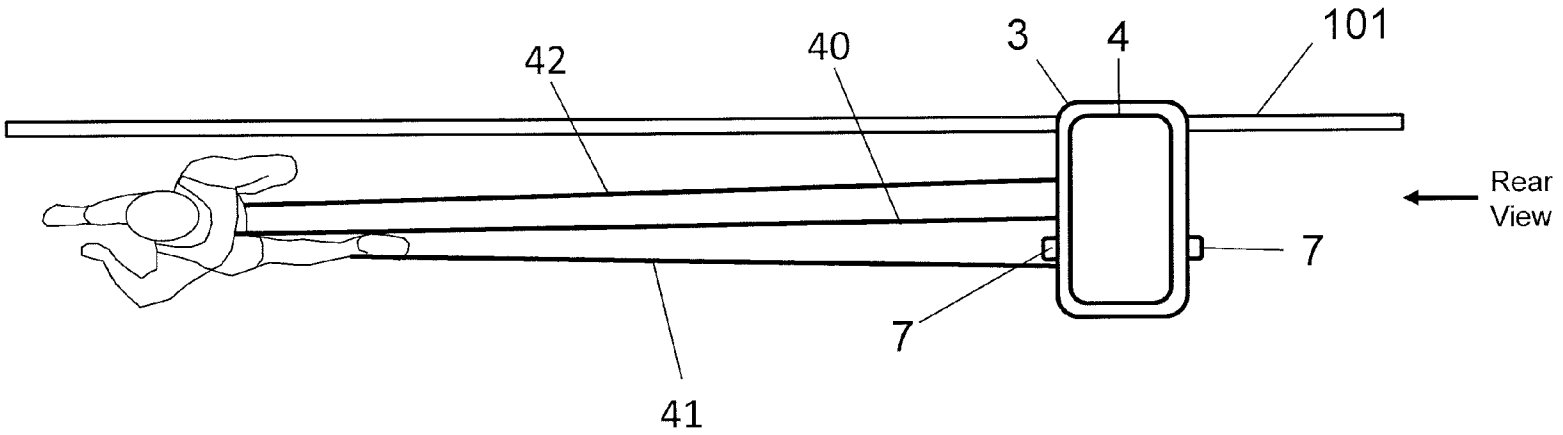
FIG. 25 is a top view of another embodiment of the present disclosure.
Figure 26:
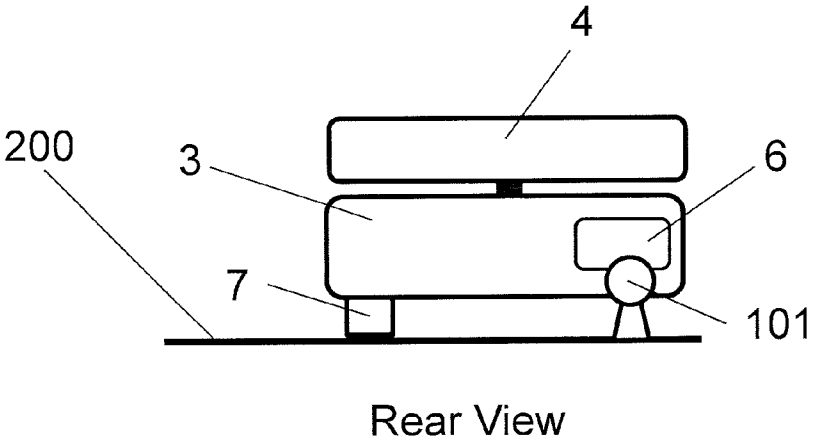
FIG. 26 is a rear view of the embodiment illustrated in FIG. 25.

FIG. 25 is another embodiment of the present disclosure including a single above ground rigid rail 101 supported by the training surface 200. The rail 101 guides the mobile training module 3 and provides a stable structure for coupling with the braking/drive element 6. This embodiment may be advantageous utilizing the invention in a setting having a defined training path such as a running track. FIG. 26 illustrates a training surface level rear view of the system illustrated in FIG. 25.

Figure 27:
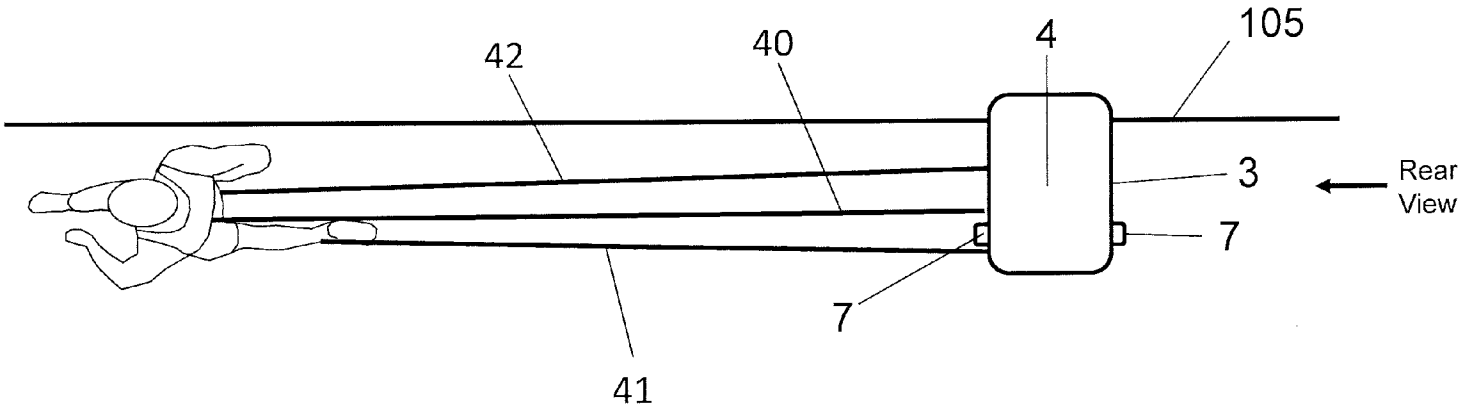
FIG. 27 is a top view of another embodiment of the present disclosure.
Figure 28:
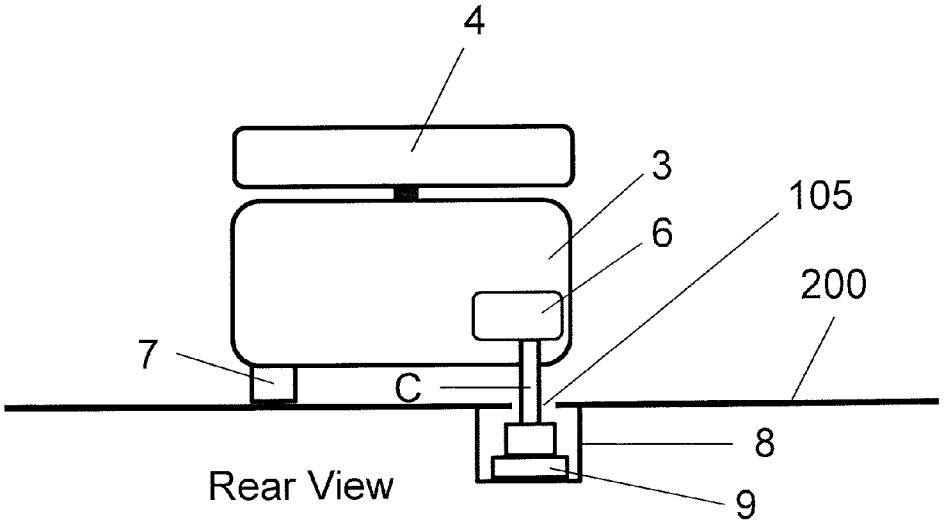
FIG. 28 is a rear view of the embodiment illustrated in FIG. 27.

FIG. 27 illustrates another embodiment of the disclosure including a cavity 8 formed below the training surface 200 with slot 105 formed in the training surface 200 providing access to the cavity 8. The rigid rail 9 is positioned in the cavity 8 and the braking/drive element 6 is coupled to the rail 9 by coupling element C for coupling braking or driving forces between the mobile training module 3 and the rail 9. FIG. 28 illustrates training surface level rear view of the embodiment illustrated in FIG. 27.

Figure 29:
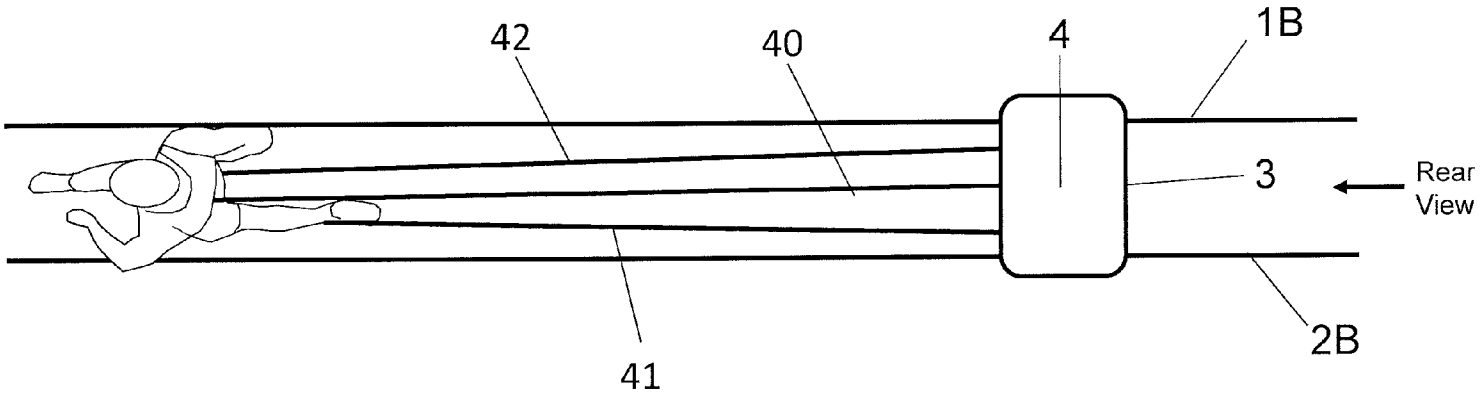
FIG. 29 is a top view of another embodiment of the present disclosure.
Figure 30:
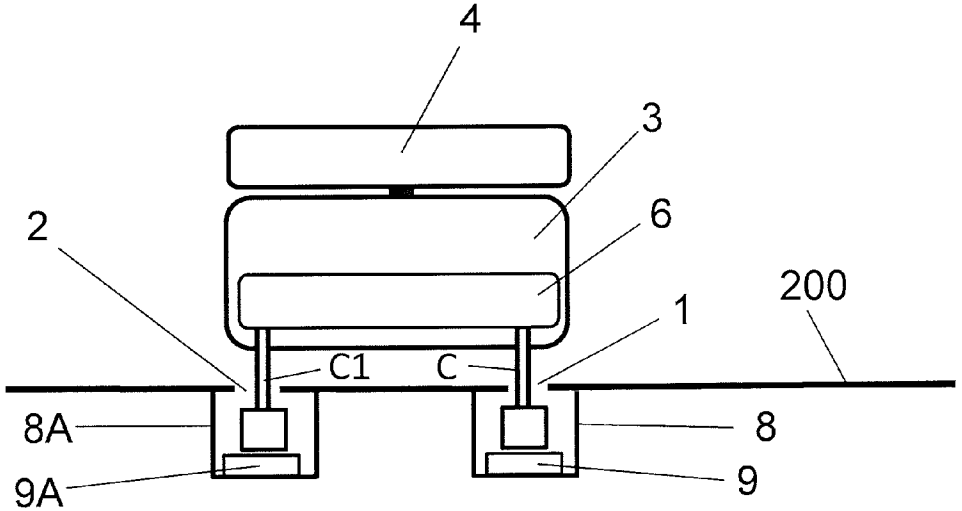
FIG. 30 is a rear view of the embodiment illustrated in FIG. 29.

FIGS. 29 and 30 illustrate an embodiment including a pair of cavities 8 and rails 9 for guiding the mobile training module 3 and coupling the braking and driving forces of the module 3.

With reference to the embodiments of the present disclosure as shown in FIGS. 6-12, a the Trainee may deploy grooved coupling bands 1,2 parallel to one another and thread grooved coupling bands 1,2 couple the bands to the mobile training module 3. The coupling bands are secured to the training surface 200 by any suitable means. The trainee may then program the training system using a remote hand held unit or keyed entry to set the desired training resistance while running (or performing any other appropriate mode of self-locomotion). A light weight, low voltage internal battery system contained in a housing of the mobile training module controls the data entry and resistance mechanism, for example an air dampening ergometer or a disk breaking system. A meter may be carried by the mobile training module 3 for measuring cumulative force applied by the tethers so that the resistance may be automatically controlled based on the measured resistive force. As the trainee begins to accelerate, the level of braking will increase or decrease until the force detected on the tethers attached to the trainee is within a specified range of the desired load programed into the unit by the trainee. The apparatus actively alters braking while the trainee is accelerating or decelerating to keep resistance within the programmed resistance profile, for example, a constant resistance over distance may be programmed. The trainee could also program the unit to decrease resistance as velocity increases or increase resistance as velocity increases. Many programmable options are possible that alter resistance as a function of acceleration, velocity and time.

When training on a linear training path, the trainee may reverse direction without uncoupling the mobile training module 3 from the coupling bands 1,2 as shown in the embodiment of FIG. 7A.

FIGS. 14-24 illustrate embodiments where one or more resistance modules 4 may be carried by the mobile training module 3 to provide resistance tethers 40-43 of extended length that may be attached to any portion of the trainee. The elastic resistance tethers 40-43 are routed on pulley systems contained by resistance module 4 to provide relatively constant loading to the trainee while running over surface 200. The embodiment of FIG. 14 allows mobile training module 3 to apply relatively constant resistance to both the drive and swing phases of running in addition to the arm drive on both arms for unlimited distances.

FIGS. 25-30 illustrate alternate coupling systems which provide for linear or non-linear training paths.

Although examples are illustrated and described herein, embodiments are nevertheless not limited to the details shown, since various modifications and structural changes may be made therein by those of ordinary skill within the scope and range of equivalents of the claims.

What is claimed is:

1. A physical training system for providing resistance to a trainee during self-locomotion, said system comprising:

a mobile training module;

one or more drive phase loading resistance members anchored at one end to said training module and adapted to be connected to the trainee to thereby effect loading of the trainee during a plurality of drive phases of the act of self-locomotion; and one or more swing phase loading resistance members anchored at one end to said training module and adapted to be connected to the trainee to thereby effect loading of the trainee during a plurality of swing phases of the act of self-locomotion, wherein said one or more drive phase or swing phase loading resistance members are at least partly housed in one or more resistance modules for loading the trainee during a plurality of drive or swing phases during the act of self-locomotion, said resistance module being carried by said mobile training module, said resistance module comprising:

an elastic cord having one end secured by an anchor and a free end adapted to be connected to a selected portion of the trainee; and a plurality of tracking mechanisms directing said elastic cord from said anchor to said free end; and wherein the drive phase and swing phase loading to the trainee during the act of self-locomotion being independent of the distance locomoted by the trainee.

2. The physical training system of claim 1 wherein said mobile training module is adapted to shadow the trainee while the trainee locomotes along a predetermined training path.

3. The physical training system of claim 2 wherein said mobile training module comprises wheels for locomotion along the training path.

4. The physical training system of claim 2 wherein said mobile training module comprises means for locomotion on one or more rails or belts.

5. The physical training system of claim 2 wherein said mobile training module is adapted to be towed by the trainee.

6. The physical training system of claim 1 wherein said one or more drive phase loading resistance members are adapted to be connected to a midsection of the trainee.

7. The physical training system of claim 6 wherein said one or more swing phase loading resistance members are adapted to be connected to a leg of the trainee.

8. The physical training system of claim 1 wherein said one or more swing phase loading resistance members are adapted to be connected to a leg of the trainee.

9. The physical training system of claim 1 wherein at least one of said drive phase or swing phase loading resistance members comprises an elastic cord.

10. The physical training system of claim 9 comprising a pair of swing phase loading resistance members, each member comprising an elastic cord adapted to be attached to a leg of the trainee.

11. The physical training system of claim 1 comprising a pair of resistance modules carried by said mobile training module for loading legs of the trainee during a plurality of swing phases during the act of self-locomotion.

12. The physical training system of claim 1 wherein said mobile training module locomotes along a training path at selectable velocity and acceleration.

13. A physical training system for providing resistance to a trainee during self-locomotion, said system comprising:

a mobile training module;

a pair of drive belts defining a training path, said mobile training module being coupled to said belts and being adapted to move along the training path at varying and selectable velocities and accelerations;

one or more drive phase loading resistance members anchored at one end to said training module and adapted to be connected to the trainee to thereby effect loading of the trainee during a plurality of drive phases of the act of self-locomotion; and one or more swing phase loading resistance members anchored at one end to said training module and adapted to be connected to the trainee to thereby effect loading of the trainee during a plurality of swing phases of the act of self-locomotion, wherein the drive phase and swing phase loading to the trainee during the act of self-locomotion being independent of the distance locomoted by the trainee.

14. A physical training system for providing resistance to a trainee during the act of self-locomotion, said system comprising:

a mobile training module; and one or more resistance members anchored at one end to said training module and adapted to be attached to the trainee at the other end, wherein said one or more resistance members are at least partly housed in one or more resistance modules for loading the trainee during the act of self-locomotion, said resistance module being carried by said mobile training module, said resistance module comprising:

an elastic cord having one end secured by an anchor and a free end adapted to be connected to a selected portion of the trainee; and a plurality of tracking mechanisms directing said elastic cord from said anchor to said free end;

said mobile training module being spaced from the trainee at a predetermined distance and being adapted to move with the trainee during the act of self-locomotion over a predetermined path, said system providing a selectively constant or varying load to the trainee during a plurality of drive and swing phases while the trainee self-locomotes over the predetermined path, wherein said load is independent of the distance locomoted by the trainee.

15. The physical training system of claim 14 wherein said mobile training module is adapted to shadow the trainee while the trainee locomotes along a predetermined training path.

16. The physical training system of claim 15 wherein said mobile training module comprises wheels for locomotion along the training path.

17. The physical training system of claim 15 wherein said mobile training module comprises means for locomotion on one or more rails or belts.

18. The physical training system of claim 15 wherein said mobile training module is adapted to be towed by the trainee.

19. The physical training system of claim 14 wherein said one or more resistance members are adapted to be connected to a midsection of the trainee.

20. The physical training system of claim 19 wherein said resistance members are adapted to be connected to a leg of the trainee.

21. The physical training system of claim 14 wherein said one or more resistance members are adapted to be connected to a leg of the trainee.

22. The physical training system of claim 14 wherein at least one of said resistance members comprises an elastic cord.

23. The physical training system of claim 14 wherein one or more resistance modules comprise a plurality of elastic cords.

24. The physical training system of claim 14 comprising a pair of resistance modules carried by said mobile training module for loading the trainee during the act of self-locomotion.

25. A physical training system for providing resistance to a trainee during the act of self-locomotion along a training path, said system comprising:

a mobile training module for providing resistance to the trainee as the trainee locomotes along the training path, said mobile training module comprising:

a chassis;

a housing carried by said chassis;

a breaking mechanism for providing resistance to the movement of said mobile training module along the training path; and a controller for controlling said breaking mechanism, said controller being programmable for selectively controlling the resistance to the movement of said mobile training module to thereby control the velocity and acceleration of said mobile training module, and one or more resistance modules for loading the trainee during a plurality of drive or swing phases during the act of self-locomotion, said resistance module being carried by said mobile training module, said resistance module comprising:

an elastic cord having one end secured by an anchor and a free end adapted to be connected to a selected portion of the trainee; and a plurality of tracking mechanisms directing said elastic cord from said anchor to said free end.

26. The physical training system of claim 25 further comprising a pair of drive belts defining the training path, said breaking mechanism being coupled to at least one of said drive belts for creating a breaking force opposing the movement of said mobile training module along the training path.

27. The physical training system of claim 25 further comprising one or more rigid rails defining the training path, said breaking mechanism being coupled to at least one of said rails for creating a breaking force opposing the movement of said mobile training module along the training path.

28. The physical training system of claim 27 wherein one or more of said rigid rails is positioned above a training surface.

29. The physical training system of claim 27 wherein one or more of said rigid rails is positioned below a training surface.

30. The physical training system of claim 25 further comprising one or more wheels supporting said chassis for facilitating movement of said mobile training module along the training path.

* * * * *